US009816408B2

(12) United States Patent
Haltiner, Jr.

(10) Patent No.: US 9,816,408 B2
(45) Date of Patent: Nov. 14, 2017

(54) CAMSHAFT PHASER

(71) Applicant: DELPHI TECHNOLOGIES, INC., Troy, MI (US)

(72) Inventor: Karl J. Haltiner, Jr., Fairport, NY (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 94 days.

(21) Appl. No.: 15/050,955

(22) Filed: Feb. 23, 2016

(65) Prior Publication Data

US 2017/0241302 A1 Aug. 24, 2017

(51) Int. Cl.
*F01L 1/34* (2006.01)
*F01L 1/344* (2006.01)

(52) U.S. Cl.
CPC ..... *F01L 1/3442* (2013.01); *F01L 2001/3445* (2013.01); *F01L 2001/34423* (2013.01); *F01L 2001/34426* (2013.01); *F01L 2001/34479* (2013.01)

(58) Field of Classification Search
CPC ..... F01L 1/3442; F01L 2001/34423; F01L 2001/34426; F01L 2001/3445; F01L 2001/34479
USPC ..... 123/90.15, 90.17
See application file for complete search history.

(56) References Cited

U.S. PATENT DOCUMENTS

| | | | | |
|---|---|---|---|---|
| 7,000,580 | B1 | 2/2006 | Smith et al. | |
| 7,137,371 | B2 | 11/2006 | Simpson et al. | |
| 8,534,246 | B2 | 9/2013 | Lichti et al. | |
| 8,820,280 | B2 * | 9/2014 | Smith | F01L 1/3442 123/90.17 |
| 2013/0206088 | A1 | 8/2013 | Wigsten | |

OTHER PUBLICATIONS

Karl J. Haltiner, Jr., "Camshaft Phaser", U.S. Appl. No. 14/936,912, filed Nov. 10, 2015.
Karl J. Haltiner, Jr. et al., "Camshaft Phaser", U.S. Appl. No. 14/936,888, filed Nov. 10, 2015.

* cited by examiner

*Primary Examiner* — Ching Chang
(74) *Attorney, Agent, or Firm* — Joshua M. Haines

(57) ABSTRACT

A camshaft phaser includes an input member an output member defining an advance chamber and a retard chamber; a valve spool having a valve spool bore; a first recirculation check valve and a second recirculation check valve disposed within the valve spool bore; and a biasing member which biases the first recirculation check valve and the second recirculation check valve away from each other. The first recirculation check valve allows oil to pass from the advance chamber to the retard chamber and prevents oil from passing from the retard chamber to the advance chamber when the valve spool is in a retard position. The second recirculation check valve allows oil to pass from the retard chamber to the advance chamber and prevents oil from passing from the advance chamber to the retard chamber when the valve spool is in an advance position.

18 Claims, 37 Drawing Sheets

CAMSHAFT PHASER

TECHNICAL FIELD OF INVENTION

The present invention relates to a camshaft phaser for varying the phase relationship between a crankshaft and a camshaft in an internal combustion engine; more particularly to such a camshaft phaser which is a vane-type camshaft phaser; even more particularly to a vane-type camshaft phaser which uses torque reversals of the camshaft to actuate the camshaft phaser.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers by a phasing oil control valve in order to rotate the rotor within the stator and thereby change the phase relationship between the camshaft and the crankshaft. One such camshaft phaser is described in U.S. Pat. No. 8,534,246 to Lichti et al., the disclosure of which is incorporated herein by reference in its entirety and hereinafter referred to as Lichti et al.

While the camshaft phaser of Lichti et al. may be effective, the camshaft phaser may be parasitic on the lubrication system of the internal combustion engine which also supplies the oil for rotating the rotor relative to the stator, thereby requiring increased capacity of an oil pump of the internal combustion engine which adds load to the internal combustion engine. In an effort to reduce the parasitic nature of camshaft phasers, so-called cam torque actuated camshaft phasers have also been developed. In a cam torque actuated camshaft phaser, oil is moved directly from the advance chambers to the retard chambers or directly from the retard chambers to the advance chambers based on torque reversals imparted on the camshaft from intake and exhaust valves of the internal combustion engine. The torque reversals are predictable and cyclical in nature and alternate from tending to urge the rotor in the advance direction to tending to urge the rotor in the retard direction. The effects of the torque reversals on oil flow are known to be controlled by a valve spool positioned by a solenoid actuator. Accordingly, in order to advance the camshaft phaser, the valve spool is positioned by the solenoid actuator to create a passage with one or more check valves which allow torque reversals to transfer oil from the advance chambers to the retard chambers while preventing torque reversals from transferring oil from the retard chambers to the advance chambers. Conversely, in order to retard the camshaft phaser, the valve spool is positioned by the solenoid actuator to create a passage with the one or more check valves which allow torque reversals to transfer oil from the retard chambers to the advance chambers while preventing torque reversals from transferring oil from the advance chambers to the retard chambers. One such camshaft phaser is described in U.S. Pat. No. 7,000,580 to Smith et al., hereinafter referred to as Smith et al. Smith et al. teaches an arrangement which uses two check valves located within a valve spool in order to allow oil to flow from the chambers which need to decrease in volume to the chambers which need to increase in volume while preventing oil flow in the reverse direction.

In operation, when torque reversals of the camshaft cause oil to tend flow in the reverse direction, high pressure oil is applied only to one check valve. Consequently, high pressure oil from the reversing torque reversal is applied to a large volume which requires substantial structure to resist the high oil pressure.

Another such cam torque actuated camshaft phaser is described in U.S. Pat. No. 7,137,371 to Simpson et al., hereinafter referred to as Simpson et al. Simpson et al. differs from Smith et al. in that Simpson et al. requires only one check valve to transfer oil from the advance chambers to the retard chambers and to transfer oil from the retard chambers to the advance chambers. While Simpson et al. eliminates one check valve compared to Smith et al., the passages of Simpson et al. that are required to implement the single check valve add further complexity because the check valve is located remotely from the valve spool.

Yet another such cam torque actuated camshaft phaser is described in United States Patent Application Publication No. US 2013/0206088 A1 to Wigsten, hereinafter referred to as Wigsten. Wigsten differs from Simpson et al. in that the check valve that is used to transfer oil from the advance chambers to the retard chambers and to transfer oil from the retard chambers to the advance chambers is located within the valve spool. However, placement of the check valve within the valve spool as implemented by Wigsten complicates the manufacture of the valve spool and adds further complexity to passages needed in the valve body within which the valve spool is slidably disposed.

What is needed is camshaft phaser which minimizes or eliminates one or more the shortcomings as set forth above.

SUMMARY OF THE INVENTION

Briefly described, a camshaft phaser for controllably varying the phase relationship between a crankshaft and a camshaft in an internal combustion engine includes an input member connectable to the crankshaft of the internal combustion engine to provide a fixed ratio of rotation between the input member and the crankshaft; an output member connectable to the camshaft of the internal combustion engine and defining an advance chamber and a retard chamber with the input member; a valve spool moveable along an axis between an advance position and a retard position and having a valve spool bore with a phasing volume defined within the valve spool bore, the valve spool having a spool recirculation passage extending from the valve spool bore; a first recirculation check valve disposed within the valve spool bore such that the first recirculation check valve is moveable axially within the valve spool bore; a second recirculation check valve disposed within the valve spool bore such that the second recirculation check valve is moveable axially within the valve spool bore; and a biasing member which biases the first recirculation check valve and the second recirculation check valve away from each other. The first recirculation check valve allows oil to pass from the advance chamber to the retard chamber through the spool recirculation passage when the valve spool is in the retard position and the first recirculation check valve prevents oil from passing from the retard chamber to the advance chamber when the valve spool is in the retard position, thereby retarding the timing of the camshaft relative to crankshaft. The second recirculation check valve allows oil to pass from the retard chamber to the advance chamber through the spool recirculation passage when the valve spool is in the advance position and the second recirculation check valve prevents oil from passing from the advance chamber to the retard chamber when the valve spool is in the advance position, thereby advancing the timing of the camshaft relative to the crankshaft.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
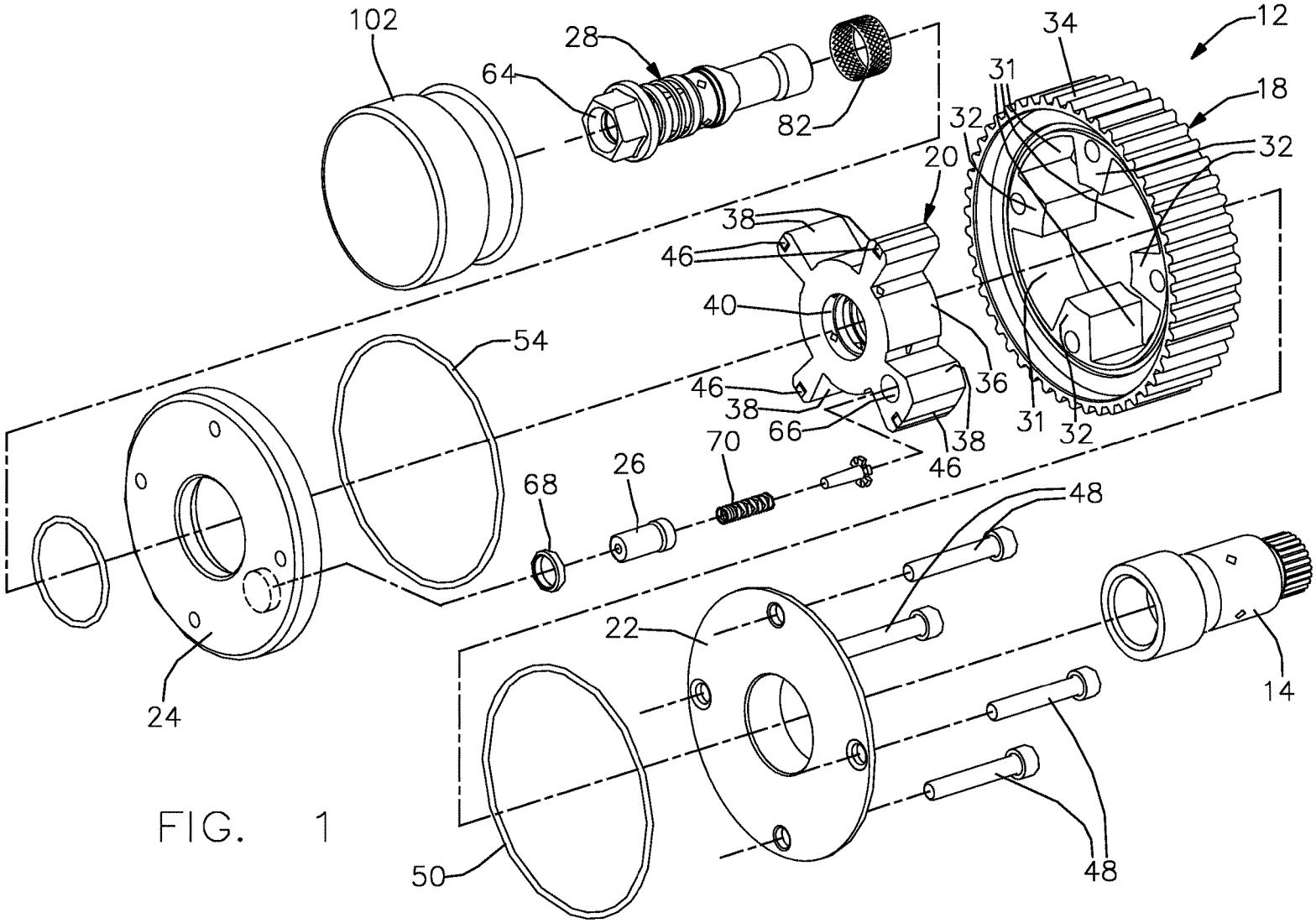
FIG. 1 is an exploded isometric view of a camshaft phaser in accordance with the present invention.

In accordance with a preferred embodiment of this invention and referring first to FIGS. 1-4, an internal combustion engine 10 is shown which includes a camshaft phaser 12. Internal combustion engine 10 also includes a camshaft 14 which is rotatable about a camshaft axis 16 based on rotational input from a crankshaft and belt (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18 which acts and an input member, a rotor 20 disposed coaxially within stator 18 which acts as an output member, a back cover 22 closing off one end of stator 18, a front cover 24 closing off the other end of stator 18, a lock pin 26 which selectively prevents rotation of rotor 20 relative to stator 18, a camshaft phaser attachment bolt 28 for attaching camshaft phaser 12 to camshaft 14, and a valve spool 30 which directs oil for rotating rotor 20 relative to stator 18. The various elements of camshaft phaser 12 will be described in greater detail in the paragraphs that follow.

Stator 18 is generally cylindrical and includes a plurality of radial chambers 31 defined by a plurality of lobes 32 extending radially inward. In the embodiment shown, there are four lobes 32 defining four radial chambers 31, however, it is to be understood that a different number of lobes 32 may be provided to define radial chambers 31 equal in quantity to the number of lobes 32. Stator 18 may also include a toothed pulley 34 formed integrally therewith or otherwise fixed thereto. Pulley 34 is configured to be driven by a belt that is driven by the crankshaft of internal combustion engine 10. Alternatively, pulley 34 may be a sprocket driven by a chain or other any other known drive member known for driving camshaft phaser 12 by the crankshaft.

Rotor 20 includes a central hub 36 with a plurality of vanes 38 extending radially outward therefrom and a rotor central through bore 40 extending axially therethrough. The number of vanes 38 is equal to the number of radial chambers 31 provided in stator 18. Rotor 20 is coaxially disposed within stator 18 such that each vane 38 divides each radial chamber 31 into advance chambers 42 and retard chambers 44. The radial tips of lobes 32 are mateable with central hub 36 in order to separate radial chambers 31 from each other. Each of the radial tips of vanes 38 may include one of a plurality of wiper seals 46 to substantially seal adjacent advance chambers 42 and retard chambers 44 from each other. While not shown, each of the radial tips of lobes 32 may also include one of a plurality of wiper seals 46.

Back cover 22 is sealingly secured, using cover bolts 48, to the axial end of stator 18 that is proximal to camshaft 14. Tightening of cover bolts 48 prevents relative rotation between back cover 22 and stator 18. A back cover seal 50, for example only, an O-ring, may be provided between back cover 22 and stator 18 in order to provide an oil-tight seal between the interface of back cover 22 and stator 18. Back cover 22 includes a back cover central bore 52 extending coaxially therethrough. The end of camshaft 14 is received coaxially within back cover central bore 52 such that camshaft 14 is allowed to rotate relative to back cover 22. In an alternative arrangement, pulley 34 may be integrally formed or otherwise attached to back cover 22 rather than stator 18.

Similarly, front cover 24 is sealingly secured, using cover bolts 48, to the axial end of stator 18 that is opposite back cover 22. A front cover seal 54, for example only, an O-ring, may be provided between front cover 24 and stator 18 in order to provide an oil-tight seal between the interface of front cover 24 and stator 18. Cover bolts 48 pass through back cover 22 and stator 18 and threadably engage front cover 24, thereby clamping stator 18 between back cover 22 and front cover 24 to prevent relative rotation between stator 18, back cover 22, and front cover 24. In this way, advance chambers 42 and retard chambers 44 are defined axially between back cover 22 and front cover 24.

Camshaft phaser 12 is attached to camshaft 14 with camshaft phaser attachment bolt 28 which extends coaxially through rotor central through bore 40 of rotor 20 and threadably engages camshaft 14, thereby clamping rotor 20 securely to camshaft 14. In this way, relative rotation between stator 18 and rotor 20 results in a change is phase or timing between the crankshaft of internal combustion engine 10 and camshaft 14.

Oil is selectively transferred to advance chambers 42 from retard chambers 44, as result of torque applied to camshaft 14 from the valve train of internal combustion engine 10, i.e. torque reversals of camshaft 14, in order to cause relative rotation between stator 18 and rotor 20 which results in advancing the timing of camshaft 14 relative to the crankshaft of internal combustion engine 10. Conversely, oil is selectively transferred to retard chambers 44 from advance chambers 42, as result of torque applied to camshaft 14 from the valve train of internal combustion engine 10, in order to cause relative rotation between stator 18 and rotor 20 which results in retarding the timing of camshaft 14 relative to the crankshaft of internal combustion engine 10. Rotor advance passages 56 may be provided in rotor 20 for supplying and venting oil to and from advance chambers 42 while rotor retard passages 58 may be provided in rotor 20 for supplying and venting oil to and from retard chambers 44. Transferring oil to advance chambers 42 from retard chambers 44 and transferring oil to retard chambers 44 from advance chambers 42 is controlled by valve spool 30, a first recirculation check valve 60, and a second recirculation check valve 62, as will be described in detail later, such that valve spool 30 is coaxially disposed slidably within a valve bore 64 of camshaft phaser attachment bolt 28 where valve bore 64 is centered about camshaft axis 16.

Lock pin 26 selectively prevents relative rotation between stator 18 and rotor 20 at a predetermined aligned position of rotor 20 within stator 18, which as shown, may be a full advance position, i.e. rotor 20 as far as possible within stator 18 in the advance direction of rotation. Lock pin 26 is slidably disposed within a lock pin bore 66 formed in one vane 38 of rotor 20. A lock pin seat 68 is provided in front cover 24 for selectively receiving lock pin 26 therewithin. Lock pin 26 and lock pin seat 68 are sized to substantially prevent rotation between stator 18 and rotor 20 when lock pin 26 is received within lock pin seat 68. When lock pin 26 is not desired to be seated within lock pin seat 68, pressurized oil is supplied to lock pin bore 66 through a rotor lock pin passage 72 formed in rotor 20, thereby urging lock pin 26 out of lock pin seat 68 and compressing a lock pin spring 70. Conversely, when lock pin 26 is desired to be seated within lock pin seat 68, the pressurized oil is vented from lock pin bore 66 through rotor lock pin passage 72, thereby allowing lock pin spring 70 to urge lock pin 26 toward front cover 24. In this way, lock pin 26 is seated within lock pin seat 68 by lock pin spring 70 when rotor 20 is positioned within stator 18 to allow alignment of lock pin 26 with lock pin seat 68. Supplying and venting of pressurized oil to and from lock pin 26 is controlled by valve spool 30 as will be described later.

Camshaft phaser attachment bolt 28 and valve spool 30, which act together to function as a valve, will now be described in greater detail with continued reference to FIGS. 1-4 and now with additional reference to FIGS. 5A-10E. Camshaft phaser attachment bolt 28 includes a bolt annular inner supply groove 73 which extends radially outward from valve bore 64, a bolt annular outer supply groove 74 which extends radially inward from the outer surface of camshaft phaser attachment bolt 28 and surrounds bolt annular inner supply groove 73, and bolt supply passages 75 which extend radially outward from bolt annular inner supply groove 73 to bolt annular outer supply groove 74. Bolt supply passages 75 receive pressurized oil from an oil source 76, for example, an oil pump of internal combustion engine 10, via an annular oil supply passage 78 formed radially between camshaft phaser attachment bolt 28 and a counter bore of camshaft 14 and also via radial camshaft oil passages 80 of camshaft 14. The pressurized oil from oil source 76 is used to 1) replenish oil that may leak from advance chambers 42 and retard chambers 44 in use, 2) to disengage lock pin 26 from lock pin seat 68, and 3) to replenish oil that is vented from lock pin 26. A filter 82 may circumferentially surround camshaft phaser attachment bolt 28 at bolt supply passages 75 in order to prevent foreign matter that may be present in the oil from reaching valve spool 30.

Camshaft phaser attachment bolt 28 also includes a bolt annular lock pin groove 84 which extends radially outward from valve bore 64 such that bolt lock pin passages 86 extend radially outward from bolt annular lock pin groove 84 to the outer periphery of camshaft phaser attachment bolt 28. Bolt annular lock pin groove 84 is spaced axially apart from bolt annular inner supply groove 73 in a direction away from camshaft 14 and bolt lock pin passages 86 are aligned with a rotor annular lock pin groove 88 which extends radially outward from rotor central through bore 40 such that rotor lock pin passage 72 extends from rotor annular lock pin groove 88 to lock pin bore 66. In this way, fluid communication is provided between valve bore 64 and lock pin bore 66. It should be noted that rotor lock pin passage 72 has been shown out of radial position in FIGS. 5A-8C in order to simplify the description of oil flow during operation.

Camshaft phaser attachment bolt 28 also includes a bolt annular advance groove 90 which extends radially outward from valve bore 64 such that bolt advance passages 92 extend radially outward from bolt annular advance groove 90 to the outer periphery of camshaft phaser attachment bolt 28. Bolt annular advance groove 90 is spaced axially apart from bolt annular inner supply groove 73 and bolt annular lock pin groove 84 such that bolt annular lock pin groove 84 is axially between bolt annular inner supply groove 73 and bolt annular advance groove 90. Bolt advance passages 92 are aligned with a rotor annular advance groove 94 which extends radially outward from rotor central through bore 40 such that rotor advance passages 56 extend from rotor annular advance groove 94 to advance chambers 42. In this way, fluid communication is provided between valve bore 64 and advance chambers 42.

Camshaft phaser attachment bolt 28 also includes a bolt annular retard groove 96 which extends radially outward from valve bore 64 such that bolt retard passages 98 extend radially outward from bolt annular retard groove 96 to the outer periphery of camshaft phaser attachment bolt 28. Bolt annular retard groove 96 is spaced axially apart from bolt annular advance groove 90 such that bolt annular advance groove 90 is axially between bolt annular lock pin groove 84 and bolt annular retard groove 96. Bolt retard passages 98 are aligned with a rotor annular retard groove 100 which extends radially outward from rotor central through bore 40 such that rotor retard passages 58 extend from rotor annular retard groove 100 to retard chambers 44. In this way, fluid communication is provided between valve bore 64 and retard chambers 44.

Valve spool 30 is moved axially along camshaft axis 16 within valve bore 64 of camshaft phaser attachment bolt 28 by an actuator 102 and a valve spring 104 to achieve desired operational states of camshaft phaser 12 by opening and closing bolt supply passages 75, bolt lock pin passages 86, bolt advance passages 92, and bolt retard passages 98 as will now be described. Valve spool 30 is cylindrical and sized to fit within valve bore 64 in a close sliding relationship such that oil is substantially prevented from passing between the interface of valve spool 30 and valve bore 64 while allowing valve spool 30 to be displaced axially within valve bore 64 substantially uninhibited. Valve spool 30 includes a valve spool bore 106 extending axially thereinto from the end of valve spool 30 that is proximal to camshaft 14 such that valve spool bore 106 is coaxial with valve bore 64. In this way, valve spool bore 106 is defined by a valve spool bore open end 106*a* that is proximal to camshaft 14 and a valve spool bore closed end 106*b* that is distal from camshaft 14. An insert 108 is disposed within valve spool bore 106 such that insert 108 sealingly engages the inner periphery of valve spool bore open end 106*a* as will be described in greater detail later, thereby defining a phasing volume 110 axially between valve spool bore open end 106*a* and valve spool bore closed end 106*b* within which first recirculation check valve 60 and second recirculation check valve 62 are disposed as will also be described in greater detail later.

Valve spool 30 includes spool supply passages 112 which extend radially inward from the out periphery of valve spool 30 to valve spool bore 106, thereby providing fluid communication between bolt annular inner supply groove 73 and valve spool bore 106 when valve spool 30 is positioned within valve bore 64 to align spool supply passages 112 with bolt annular inner supply groove 73. Spool supply passages 112 are both preferably slots which extend in a circumferential direction about camshaft axis 16 further than in the direction of camshaft axis 16. A supply check valve 114 (best visible in FIG. 10A) is disposed within valve spool bore 106, as will be described in greater detail later, in order to allow oil to enter valve spool bore 106 from spool supply passages 112 while substantially preventing oil from exiting valve spool bore 106 to spool supply passages 112. It should be noted that spool supply passages 112 are shown out of circumferential position in FIGS. 3-8B in order to illustrate the flow path; however, the true circumferential position of spool supply passages 112 can be seen in FIG. 10A which is a radial cross-sectional view of valve spool 30, insert 108, and supply check valve 114 taken through spool supply passages 112.

Valve spool 30 also includes a spool lock pin passage 116 which extends radially inward from the outer periphery of valve spool 30 to valve spool bore 106, thereby providing fluid communication between bolt annular lock pin groove 84 and valve spool bore 106 when valve spool 30 is positioned within valve bore 64 to align spool lock pin passage 116 with bolt annular lock pin groove 84. Spool lock pin passage 116 is preferably a slot which extends in a circumferential direction about camshaft axis 16 further than in the direction of camshaft axis 16 which may most easily be seen in FIG. 10B which is a radial cross-sectional view of valve spool 30 and insert 108 taken through spool lock pin passage 116. Spool lock pin passage 116 is spaced axially from spool supply passages 112 such that spool supply passages 112 are axially between valve spool bore open end 106*a* and spool lock pin passage 116.

Valve spool 30 also includes spool advance passages 118 which extend radially inward from the out periphery of valve spool 30 to valve spool bore 106, thereby providing fluid communication between bolt annular advance groove 90 and valve spool bore 106 when valve spool 30 is positioned within valve bore 64 to align spool advance passages 118 with bolt annular advance groove 90 and also thereby providing fluid communication between bolt annular lock pin groove 84 and valve spool bore 106 when valve spool 30 is positioned within valve bore 64 to align spool advance passages 118 with bolt annular lock pin groove 84. Spool advance passages 118 are both preferably slots which extend in a circumferential direction about camshaft axis 16 further than in the direction of camshaft axis 16 which may most easily be seen in FIG. 10C which is a radial cross-sectional view of valve spool 30, first recirculation check valve 60, and insert 108 taken through spool advance passages 118. Spool advance passages 118 are spaced axially from spool lock pin passage 116 such that spool lock pin passage 116 is axially between spool supply passages 112 and spool advance passages 118.

Valve spool 30 also includes spool recirculation passages 120 which extend radially inward from the out periphery of valve spool 30 to valve spool bore 106, thereby providing fluid communication between bolt annular advance groove 90 and valve spool bore 106 when valve spool 30 is positioned within valve bore 64 to align spool recirculation passages 120 with bolt annular advance groove 90 and also thereby providing fluid communication between bolt annular retard groove 96 and valve spool bore 106 when valve spool 30 is positioned within valve bore 64 to align spool recirculation passages 120 with bolt annular retard groove 96. Spool recirculation passages 120 are both preferably slots which extend in a circumferential direction about camshaft axis 16 further than in the direction of camshaft axis 16 which may most easily be seen in FIG. 10D which is a radial cross-sectional view of valve spool 30 and insert 108 taken through spool recirculation passages 120. Spool recirculation passages 120 are spaced axially from spool advance passages 118 such that spool advance passages 118 are axially between spool lock pin passage 116 and spool recirculation passages 120.

Valve spool 30 also includes spool retard passages 122 which extend radially inward from the out periphery of valve spool 30 to valve spool bore 106, thereby providing fluid communication between bolt annular retard groove 96 and valve spool bore 106 when valve spool 30 is positioned within valve bore 64 to align spool retard passages 122 with bolt annular retard groove 96. Spool retard passages 122 are both preferably slots which extend in a circumferential direction about camshaft axis 16 further than in the direction of camshaft axis 16 which may most easily be seen in FIG. 10E which is a radial cross-sectional view of valve spool 30, second recirculation check valve 62, and insert 108 taken through spool retard passages 122. Spool retard passages 122 are spaced axially from spool recirculation passages 120 such that spool recirculation passages 120 are axially between spool advance passages 118 and spool retard passages 122.

Valve spool 30 also includes a spool vent passage 124 which extends through the end of valve spool 30 that is proximal to valve spool bore closed end 106*b*. A spool vent passage first section 124*a* extends from valve spool bore closed end 106*b* in a coaxial relationship therewith while a spool vent passage second section 124*b* extends from spool vent passage first section 124*a* in an oblique relationship with camshaft axis 16, thereby causing spool vent passage second section 124*b* to exit valve spool 30 at a location that is eccentric to camshaft axis 16, thereby allowing actuator 102 to interface with valve spool 30 at camshaft axis 16.

Figure 8A:
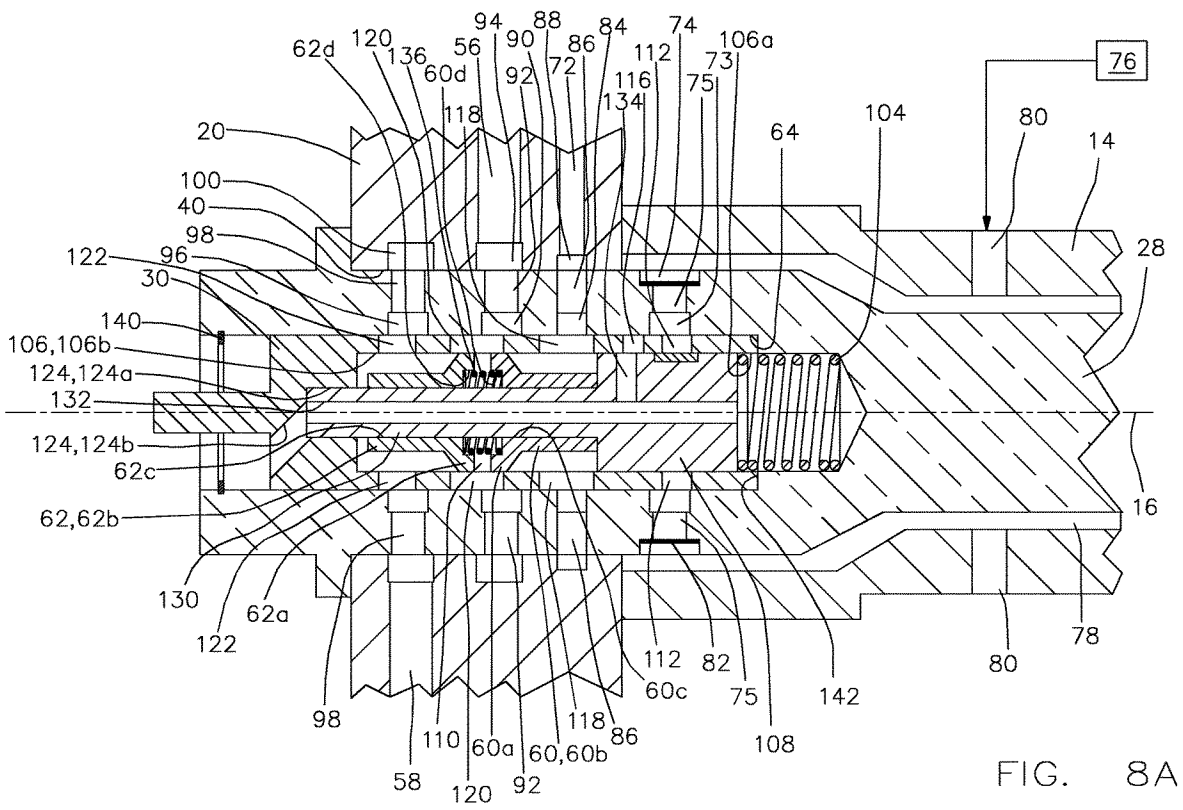
FIG. 8A is the view of FIG. 5A now shown with the valve spool in an advance position and with a second check valve open.
Figure 8B:
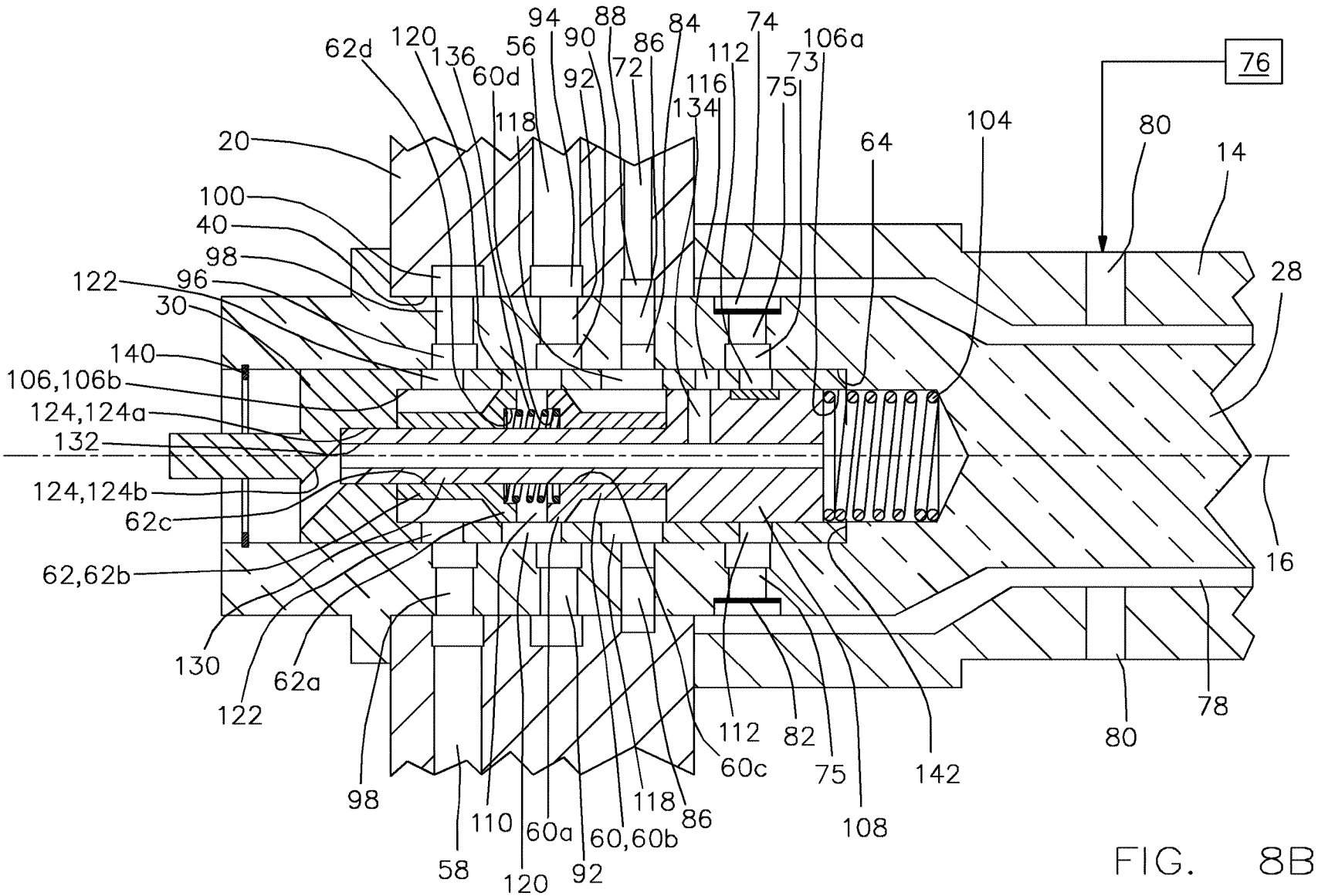
FIG. 8B is the view of FIG. 8A now with the second check valve closed.
Figure 8C:
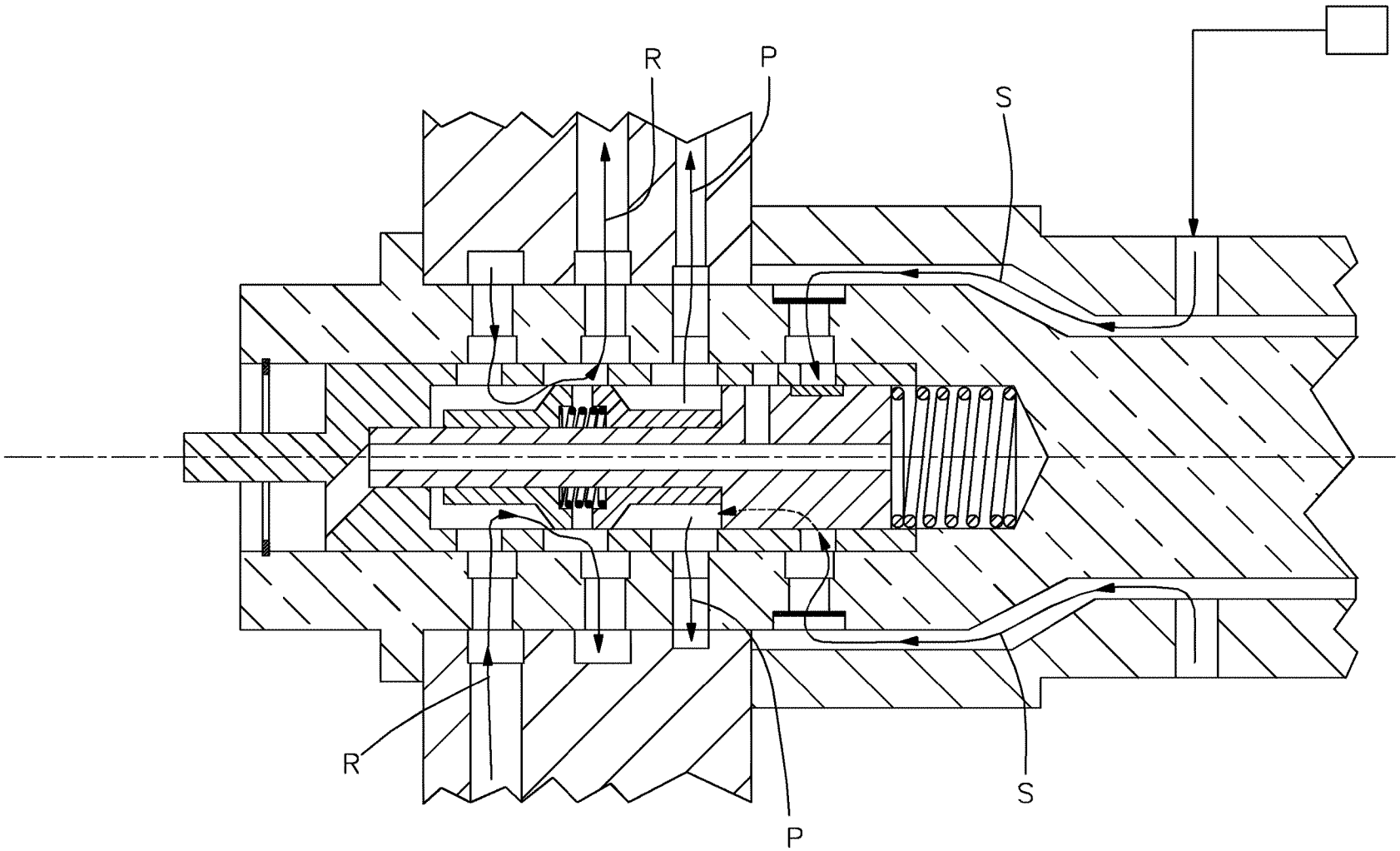
FIG. 8C is the view of FIG. 8A shown with reference numbers removed and arrows added in order to clearly show the path of travel of oil.
Figure 9:
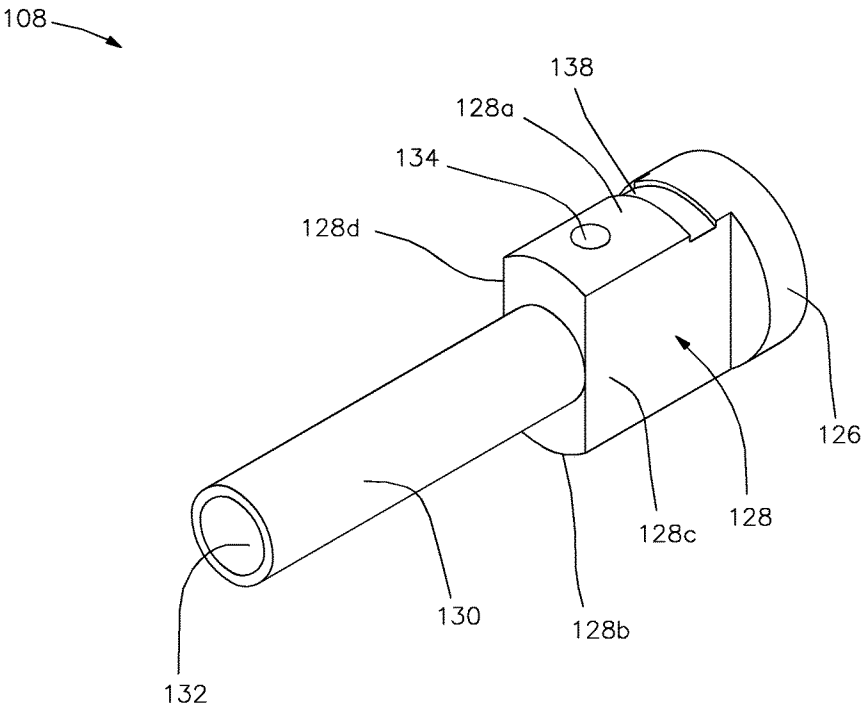
FIG. 9 is an isometric view of an insert of a valve spool of the camshaft phaser in accordance with the present invention.

With continued reference to FIGS. 1-10E and with emphasis on FIG. 9, insert 108 includes an insert end wall 126 which sealingly engages valve spool bore open end 106*a*, and consequently as shown, insert end wall 126 is circular or disk-shaped. An insert lock pin vent wall 128 extends axially from insert end wall 126 in a direction toward valve spool bore closed end 106*b*. Insert lock pin vent wall 128 takes the form of a cylinder with opposing flats formed on the periphery of the curved surface thereof such that insert lock pin vent wall 128 includes a first curved surface 128*a* which is contoured to mate with valve spool bore 106, a second curved surface 128*b* which is contoured to mate with valve spool bore 106 and which diametrically opposes first curved surface 128*a*, a first flat surface 128*c* which joins first curved surface 128*a* and second curved surface 128*b*, and a second flat surface 128*d* which joins first curved surface 128*a* and second curved surface 128*b* and which is opposed and parallel to first flat surface 128*c*. An insert recirculation check valve guide 130 extends axially from insert lock pin vent wall 128 such that insert lock pin vent wall 128 is axially between insert end wall 126 and insert recirculation check valve guide 130. Insert recirculation check valve guide 130 is cylindrical in shape and is centered about camshaft axis 16. The end of insert recirculation check valve guide 130 that is distal from insert lock pin vent wall 128 is sealingly received within spool vent passage first section 124*a*, thereby preventing oil from passing directly from phasing volume 110 to spool vent passage 124. In this way, the end of insert recirculation check valve guide 130 that is distal from insert lock pin vent wall 128 is radially supported by said spool vent passage first section 124*a*. An insert vent passage 132 is centered about camshaft axis 16 and extends axially through insert 108 such that insert vent passage 132 extends through insert end wall 126, insert lock pin vent wall 128, and insert recirculation check valve guide 130, thereby providing fluid communication between the bottom of valve bore 64 and spool vent passage 124. An insert lock pin vent passage 134 extends radially outward from insert vent passage 132 through insert lock pin vent wall 128 to first curved surface 128*a* such that insert lock pin vent passage 134 is aligned with spool lock pin passage 116. In this way, fluid communication is provided from spool lock pin passage 116 to spool vent passage 124.

First recirculation check valve 60 includes a first recirculation check valve sealing portion 60*a* which is annular in shape and centered about camshaft axis 16. First recirculation check valve sealing portion 60*a* is sized to mate with valve spool bore 106 in a close sliding fit such that first recirculation check valve 60 is able to freely slide axially within valve spool bore 106 while substantially preventing oil from passing between the interface of valve spool bore 106 and first recirculation check valve sealing portion 60*a*. A first recirculation check valve guiding portion 60*b* extends axially from first recirculation check valve sealing portion 60*a* toward insert lock pin vent wall 128. First recirculation check valve guiding portion 60*b* is sized to provide radial clearance with valve spool bore 106, and consequently, phasing volume 110 is defined in part circumferentially between first recirculation check valve guiding portion 60*b* and valve spool bore 106. A first recirculation check valve guide bore 60*c* extends through first recirculation check valve 60 such that first recirculation check valve guide bore 60*c* is centered about camshaft axis 16. First recirculation check valve guide bore 60*c* is sized to mate with insert recirculation check valve guide 130 in a close sliding relationship such that first recirculation check valve 60 is able to slide axially on insert recirculation check valve guide 130 substantially uninhibited while substantially preventing oil from passing between the interface of insert recirculation check valve guide 130 and first recirculation check valve guide bore 60*c*. A first recirculation check valve counter bore 60*d* extends into first recirculation check valve sealing portion 60*a* in a coaxial relationship with first recirculation check valve guide bore 60*c* such that first recirculation check valve counter bore 60*d* is larger in diameter than first recirculation check valve guide bore 60*c*. The purpose of first recirculation check valve counter bore 60*d* will be described in greater detail later.

Second recirculation check valve 62 includes a second recirculation check valve sealing portion 62*a* which is annular in shape and centered about camshaft axis 16. Second recirculation check valve sealing portion 62*a* is sized to mate with valve spool bore 106 in a close sliding fit such that second recirculation check valve 62 is able to freely slide axially within valve spool bore 106 while substantially preventing oil from passing between the interface of valve spool bore 106 and second recirculation check valve sealing portion 62*a*. A second recirculation check valve guiding portion 62*b* extends axially from second recirculation check valve sealing portion 62*a* toward valve spool bore closed end 106*b*. Second recirculation check valve guiding portion 62*b* is sized to provide radial clearance with valve spool bore 106, and consequently, phasing volume 110 is defined in part circumferentially between second recirculation check valve guiding portion 62*b* and valve spool bore 106. A second recirculation check valve guide bore 62*c* extends through second recirculation check valve 62 such that second recirculation check valve guide bore 62*c* is centered about camshaft axis 16. Second recirculation check valve guide bore 62*c* is sized to mate with insert recirculation check valve guide 130 in a close sliding relationship such that second recirculation check valve 62 is able to slide axially on insert recirculation check valve guide 130 substantially uninhibited while substantially preventing oil from passing between the interface of insert recirculation check valve guide 130 and second recirculation check valve guide bore 62*c*. A second recirculation check valve counter bore 62*d* extends into second recirculation check valve sealing portion 62*a* in a coaxial relationship with second recirculation check valve guide bore 62*c* such that second recirculation check valve counter bore 62*d* is larger in diameter than second recirculation check valve guide bore 62*c*. A biasing member, illustrated as recirculation check valve spring 136, is disposed within first recirculation check valve counter bore 60*d* and second recirculation check valve counter bore 62*d* such that recirculation check valve spring 136 biases first recirculation check valve 60 and second recirculation check valve 62 away from each other. As shown, recirculation check valve spring 136 may be a coil compression spring.

Figure 10A:
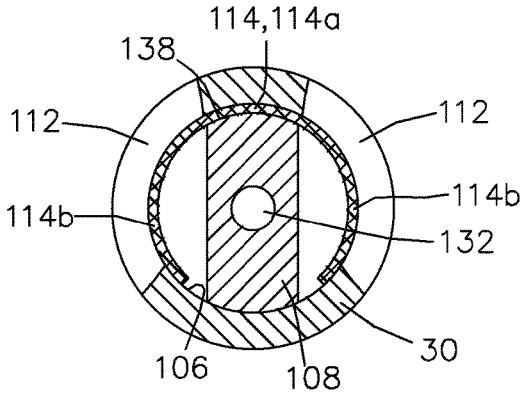
FIGS. 10A-10E are radial cross-sectional views of the valve spool and a valve spool insert of the camshaft phaser in accordance with the present invention showing passages in and out of the valve spool.
Figure 10B:
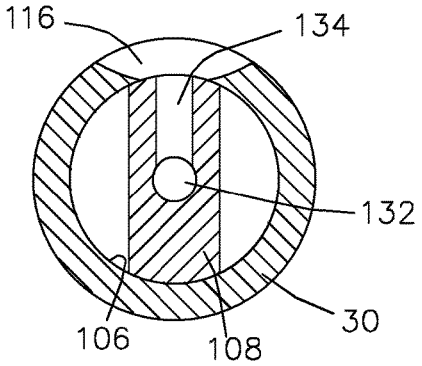
Figure 10C:
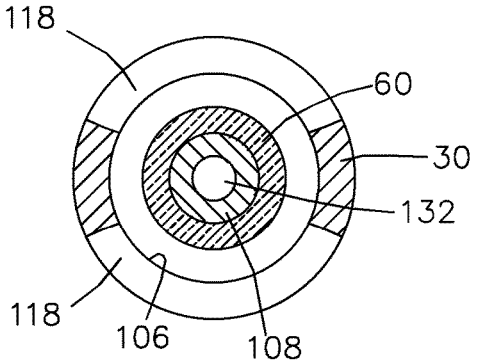
Figure 10D:
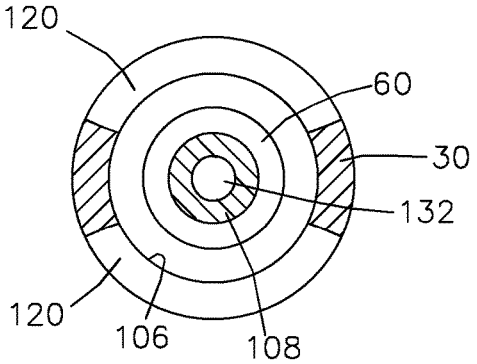
Figure 10E:
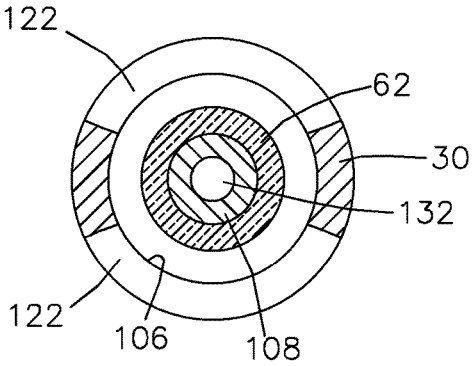

With continued reference to FIGS. 1-10E and with emphasis on FIG. 10A, supply check valve 114 may be C-shaped such that supply check valve 114 engages valve spool bore 106. A supply check valve central portion 114*a* of supply check valve 114 may be disposed within an insert supply check valve retention groove 138 formed in first curved surface 128*a* of insert lock pin vent wall 128 such that insert supply check valve retention groove 138 extends from first flat surface 128*c* to second flat surface 128*d* of insert lock pin vent wall 128. In this way, supply check valve central portion 114*a* is captured between insert supply check valve retention groove 138 and valve spool bore 106, thereby maintaining the position of supply check valve 114 within valve spool bore 106. A pair of opposing supply check valve wings 114*b* extend laterally in opposite directions from supply check valve central portion 114*a* such that each supply check valve wing 114*b* covers a respective spool supply passage 112. Supply check valve wings 114*b* are resilient and compliant such that supply check valve wings 114*b* are able to flex inward to open spool supply passages 112 when the pressure within phasing volume 110 is lower than the pressure of oil supplied by oil source 76 and such that supply check valve wings 114*b* rebound outward to block spool supply passages 112 when the pressure within phasing volume 110 is greater than or equal to the pressure of oil supplied by oil source 76.

Figure 5A:
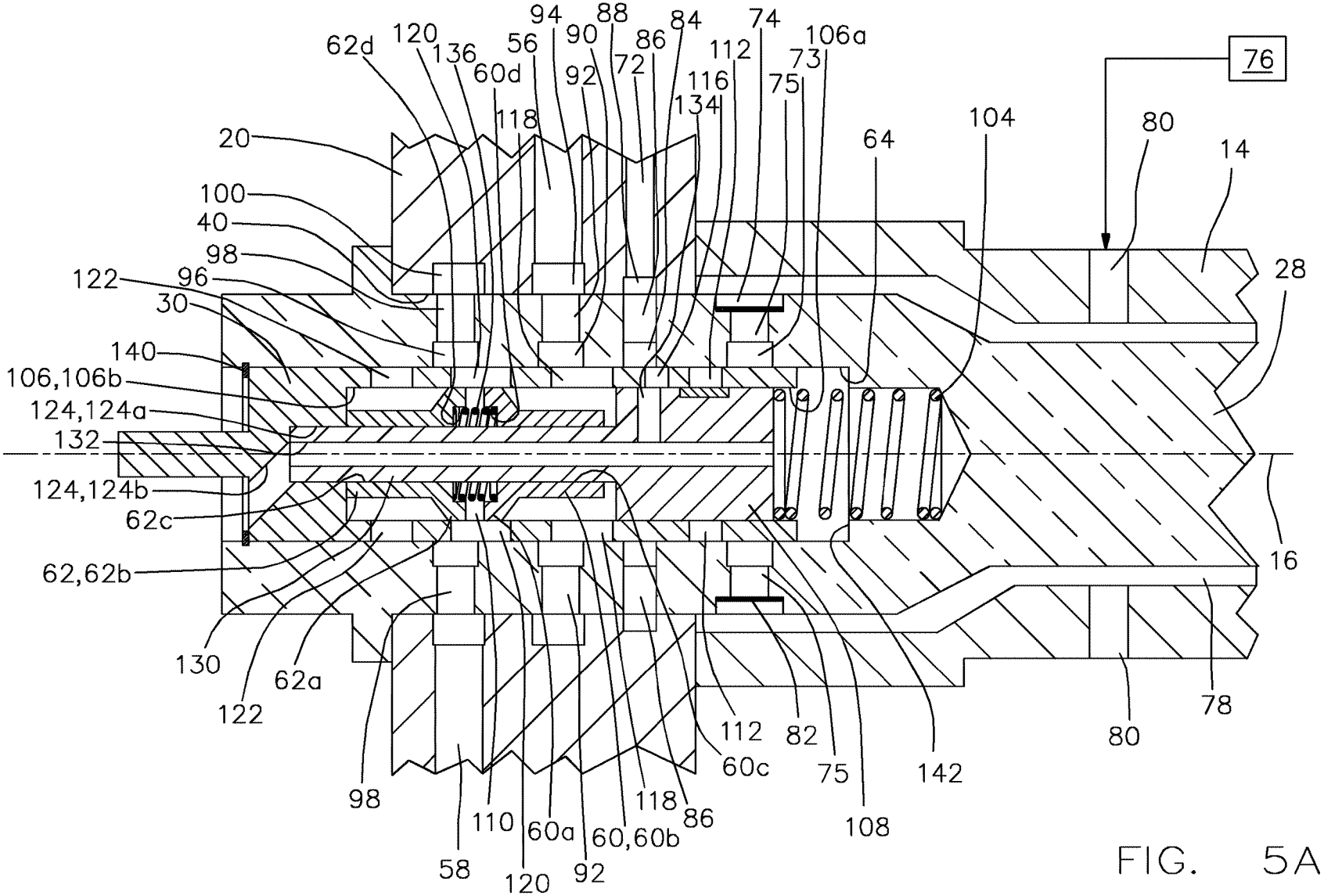
FIG. 5A is an enlarged portion of FIG. 3 showing a valve spool of the camshaft phaser in a default position and a first check valve open.
Figure 5B:
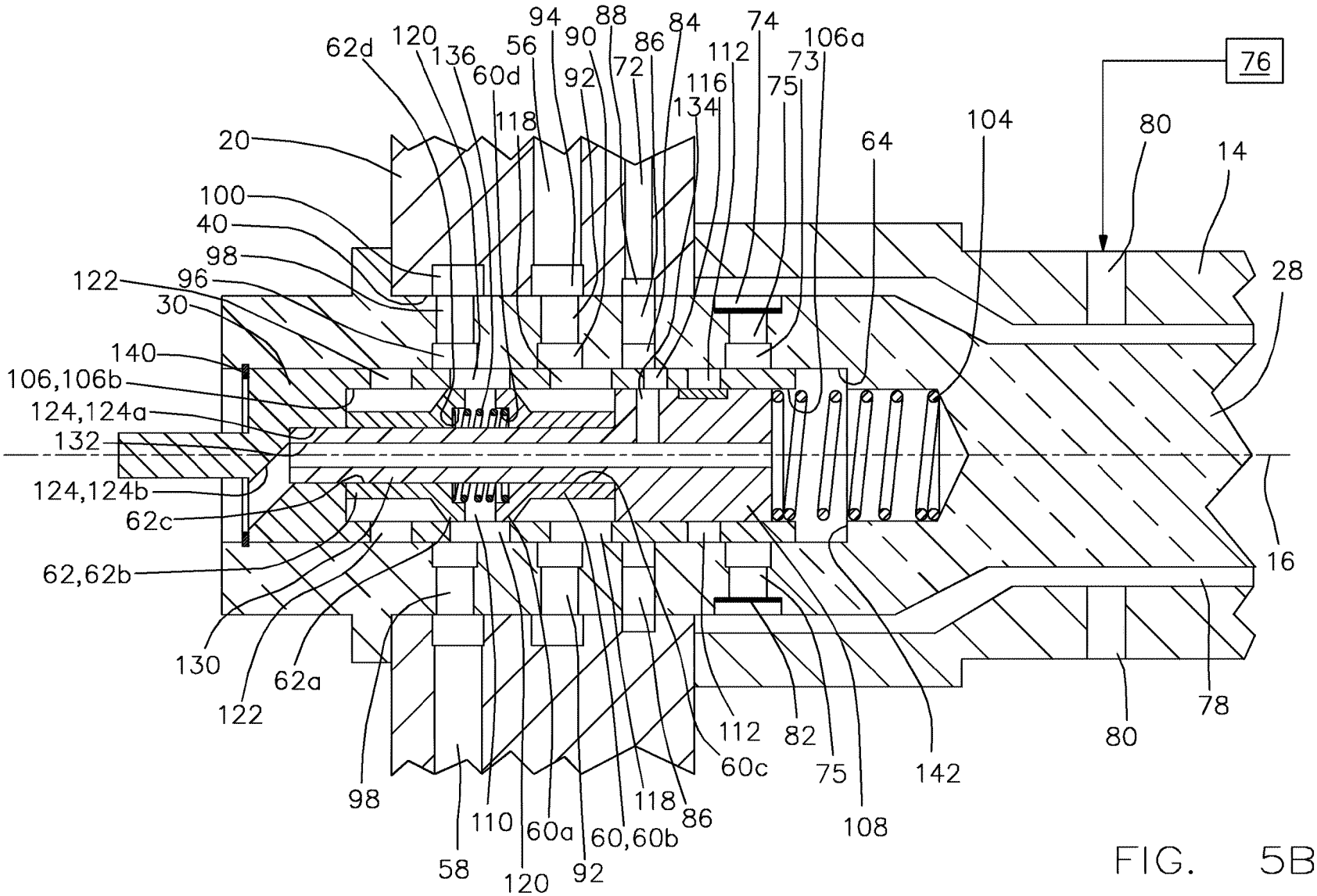
FIG. 5B is the view of FIG. 5A now with the first check valve closed.
Figure 5C:
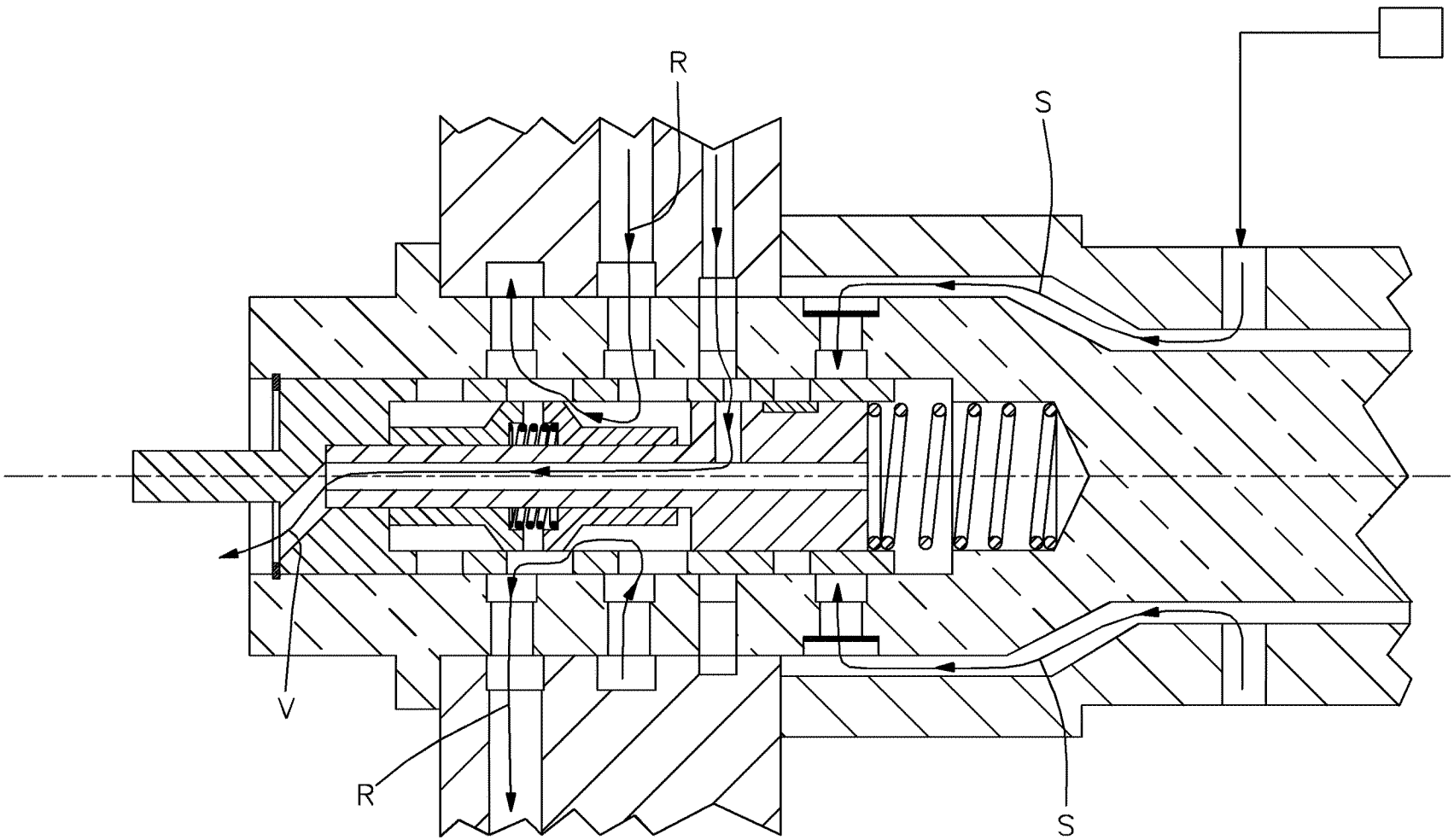
FIG. 5C is the view of FIG. 5A shown with reference numbers removed in order to clearly shown the path of travel of oil.

Actuator 102 may be a solenoid actuator that is selectively energized with an electric current of varying magnitude in order to position valve spool 30 within valve bore 64 at desired axial positions, thereby controlling oil flow to achieve desired operation of camshaft phaser 12. In a default position, when no electric current is supplied to actuator 102, valve spring 104 urges valve spool 30 in a direction toward actuator 102 as shown in FIGS. 5A-5C until valve spool 30 axially abuts a first stop member 140, which may be, by way of non-limiting example only, a snap ring within a snap ring groove extending radially outward from valve bore 64. In the default position, valve spool 30 is positioned to block bolt annular inner supply groove 73, thereby preventing pressurized oil from being supplied to phasing volume 110 from oil source 76. Also in the default position, valve spool 30 is positioned to align spool lock pin passage 116 with bolt annular lock pin groove 84, thereby allowing oil to be vented from lock pin bore 66 via rotor lock pin passage 72, rotor annular lock pin groove 88, bolt lock pin passages 86, bolt annular lock pin groove 84, spool lock pin passage 116, insert lock pin vent passage 134, insert vent passage 132, and spool vent passage 124 and consequently allowing lock pin spring 70 to urge lock pin 26 toward front cover 24. Also in the default position, valve spool 30 is positioned to block fluid communication between phasing volume 110 and spool lock pin passage 116, thereby preventing oil from being supplied from phasing volume 110 to lock pin bore 66. Also in the default position, valve spool 30 is positioned to align spool advance passages 118 with bolt annular advance groove 90, thereby allowing fluid communication between phasing volume 110 and advance chambers 42; however, fluid communication directly between spool recirculation passages 120 and bolt annular advance groove 90 is blocked. Also in the default position valve spool 30 is positioned to align spool recirculation passages 120 with bolt annular retard groove 96, thereby allowing fluid communication between phasing volume 110 and retard chambers 44. Also in the default position, valve spool 30 is positioned to prevent oil from flowing in and out of phasing volume 110 through spool retard passages 122. In this way, torque reversals of camshaft 14 that tend to pressurize oil within advance chambers 42 cause oil to be vented out of advance chambers 42 and to be supplied to retard chambers 44 via rotor advance passages 56, rotor annular advance groove 94, bolt advance passages 92, bolt annular advance groove 90, spool advance passages 118, phasing volume 110, spool recirculation passages 120, bolt annular retard groove 96, bolt retard passages 98, rotor annular retard groove 100, and rotor retard passages 58. It should be noted that torque reversals of camshaft 14 that tend to pressurize oil within advance chambers 42 cause first recirculation check valve 60 to move toward second recirculation check valve 62, thereby compressing recirculation check valve spring 136 and causing first recirculation check valve sealing portion 60*a* to permit fluid communication between spool recirculation passages 120 and spool advance passages 118 as shown in FIGS. 5A and 5C. However, torque reversals of camshaft 14 that tend to pressurize oil within retard chambers 44 are prevented from venting oil from retard chambers 44 because torque reversals that tend to pressurize oil within retard chambers 44, together with recirculation check valve spring 136, cause first recirculation check valve 60 to move away from second recirculation check valve 62 until first recirculation check valve guiding portion 60*b* abuts insert lock pin vent wall 128, thereby preventing fluid communication between spool recirculation passages 120 and spool advance passages 118 as shown in FIG. 5B. Consequently, in the default position, torque reversals of camshaft 14 cause rotor 20 to rotate relative to stator 18 to cause a retard in timing of camshaft 14 relative to the crankshaft, and when lock pin 26 is aligned with lock pin seat 68, lock pin spring 70 urges lock pin 26 into lock pin seat 68 to retain rotor 20 in the predetermined aligned position with stator 18. FIG. 5C is the same as FIG. 5A except the reference numbers have been removed for clarity and arrows representing the path of travel of the oil have been included where arrows S represent oil from oil source 76, arrows V represent vented oil from lock pin bore 66, and arrows R represent oil that is being recirculated for rotating rotor 20 relative to stator 18.

Figure 6A:
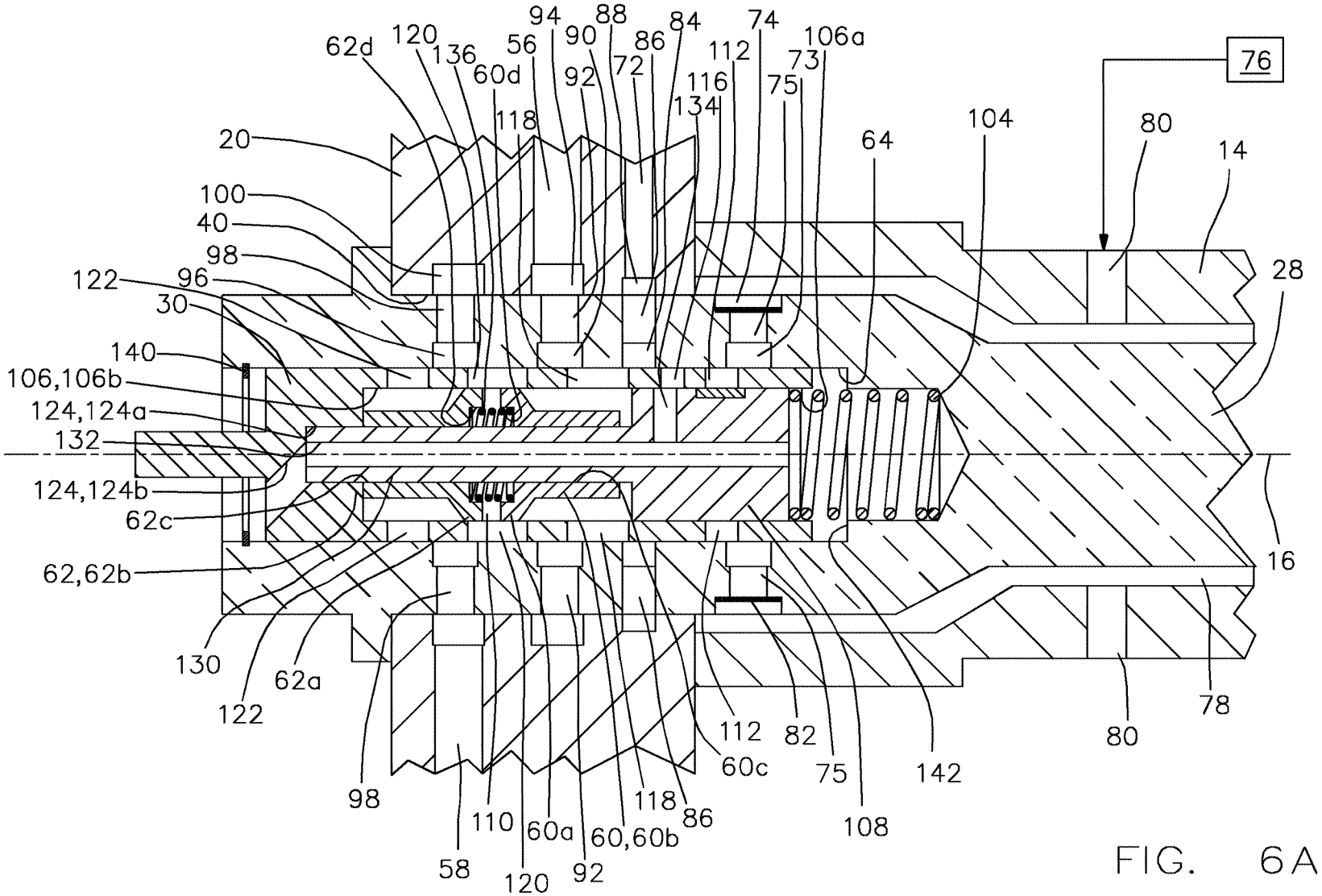
FIG. 6A is the view of FIG. 5A now shown with the valve spool in a retard position and with the first check valve open.
Figure 6B:
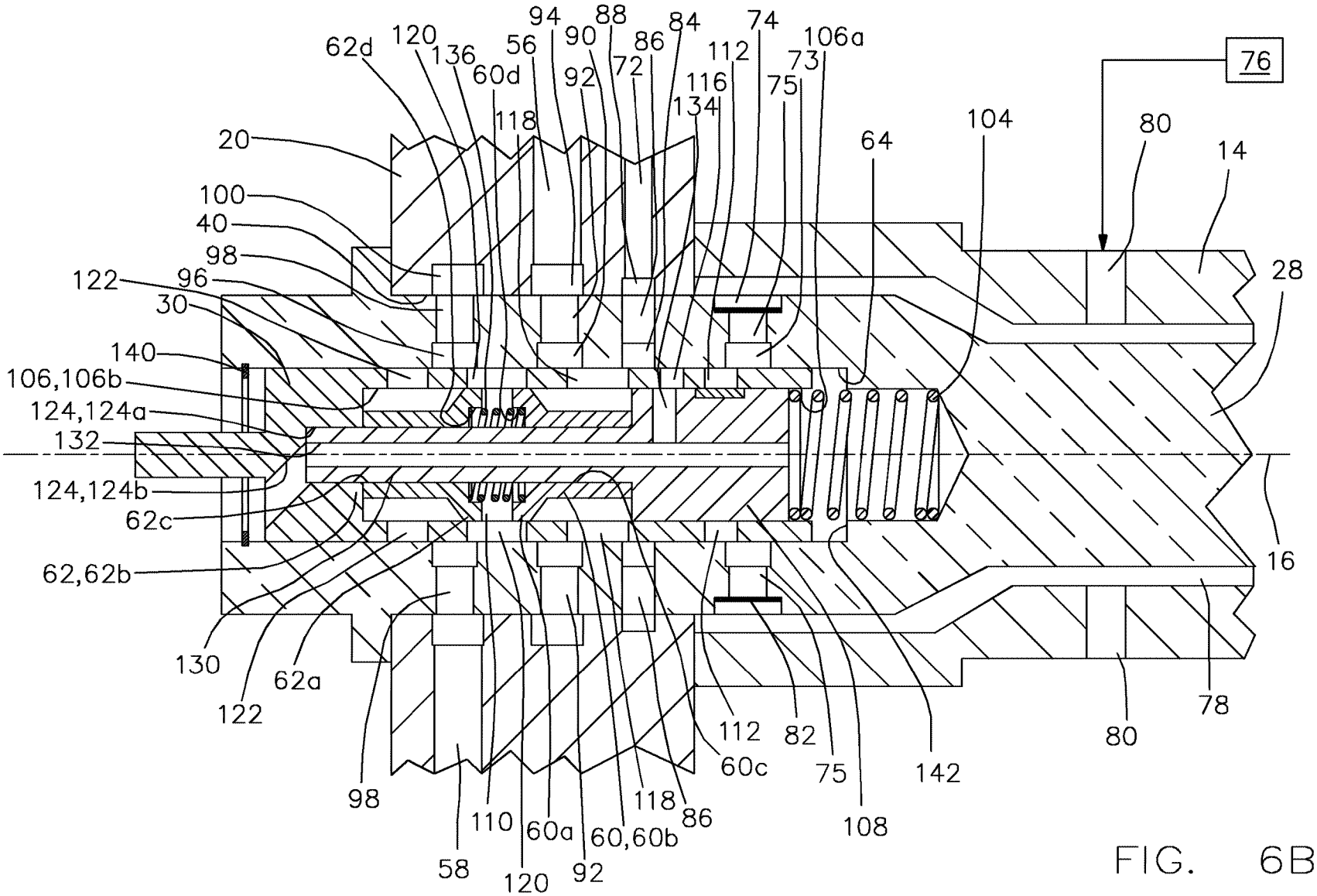
FIG. 6B is the view of FIG. 6A now with the first check valve closed.
Figure 6C:
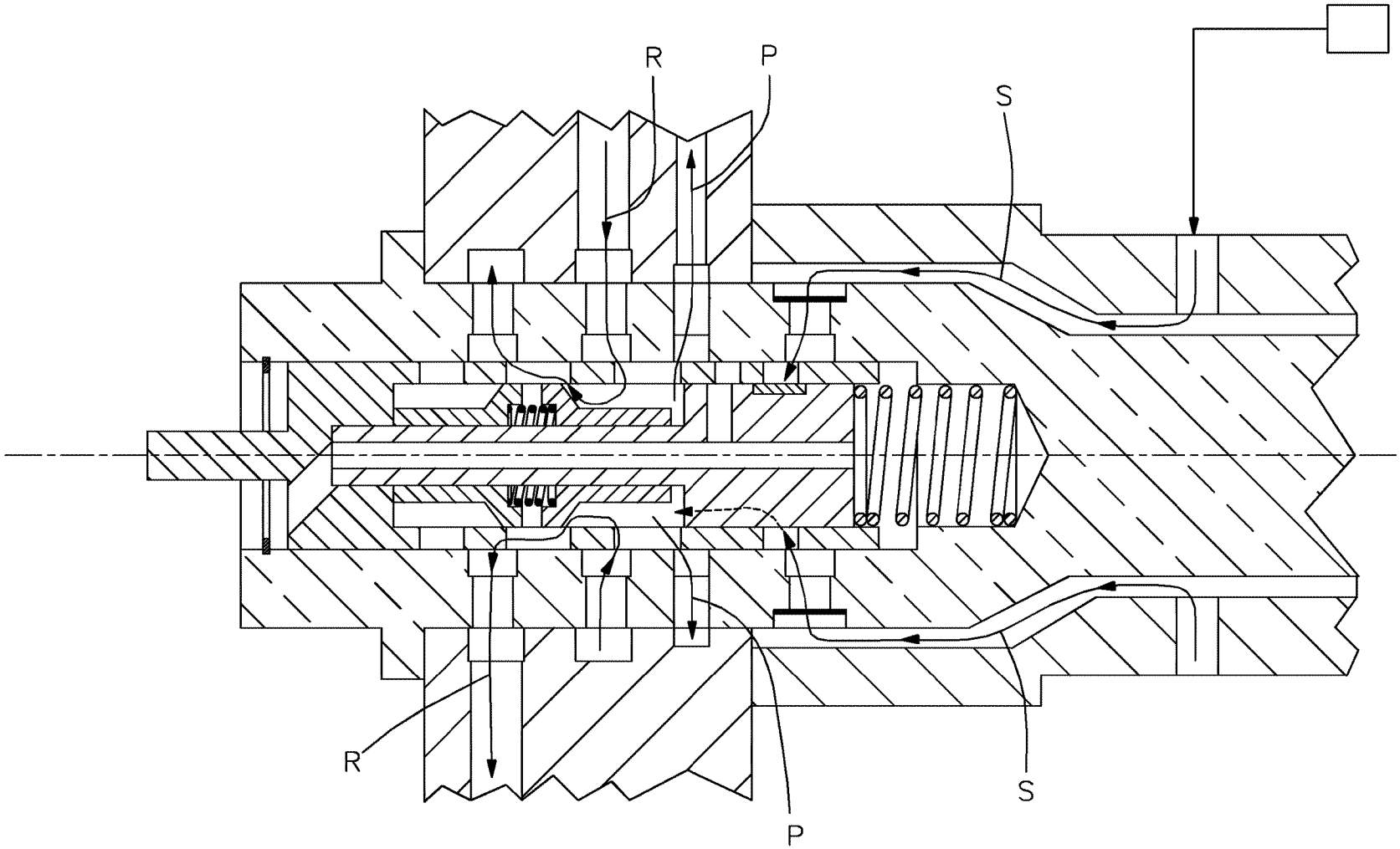
FIG. 6C is the view of FIG. 6A shown with reference numbers removed and arrows added in order to clearly show the path of travel of oil.

In a retard position, when an electric current of a first magnitude is supplied to actuator 102, actuator 102 urges valve spool 30 in a direction toward valve spring 104 as shown in FIGS. 6A-6C, thereby causing valve spring 104 to be compressed slightly. In the retard position, valve spool 30 is positioned to align spool supply passages 112 with bolt annular inner supply groove 73, thereby allowing pressurized oil to be supplied to phasing volume 110 through supply check valve 114 from oil source 76 when pressure within phasing volume 110 is lower than the pressure of oil source 76. Also in the retard position, valve spool 30 is positioned to block fluid communication between spool lock pin passage 116 and bolt annular lock pin groove 84, thereby preventing oil from being vented from lock pin bore 66. Also in the retard position, valve spool 30 is positioned to align spool advance passages 118 with bolt annular lock pin groove 84, and as a result, lock pin 26 compresses lock pin spring 70 and lock pin 26 is retracted from lock pin seat 68 due to oil supplied to lock pin bore 66 from phasing volume 110. It should be noted that by supplying oil to lock pin bore 66 from phasing volume 110, a separate dedicated supply for retracting lock pin 26 from lock pin seat 68 is not required. Also in the retard position, valve spool 30 is positioned to align spool advance passages 118 with bolt annular advance groove 90, thereby allowing fluid communication between phasing volume 110 and advance chambers 42; however, fluid communication directly between spool recirculation passages 120 and bolt annular advance groove 90 is blocked. Also in the retard position valve spool 30 is positioned to align spool recirculation passages 120 with bolt annular retard groove 96, thereby allowing fluid communication between phasing volume 110 and retard chambers 44. Also in the retard position, valve spool 30 is positioned to prevent oil from flowing in and out of phasing volume 110 through spool retard passages 122. In this way, torque reversals of camshaft 14 that tend to pressurize oil within advance chambers 42 cause oil to be vented out of advance chambers 42 and to be supplied to retard chambers 44 via rotor advance passages 56, rotor annular advance groove 94, bolt advance passages 92, bolt annular advance groove 90, spool advance passages 118, phasing volume 110, spool recirculation passages 120, bolt annular retard groove 96, bolt retard passages 98, rotor annular retard groove 100, and rotor retard passages 58. It should be noted that torque reversals of camshaft 14 that tend to pressurize oil within advance chambers 42 cause first recirculation check valve 60 to move toward second recirculation check valve 62, thereby compressing recirculation check valve spring 136 and causing first recirculation check valve sealing portion 60*a* to permit fluid communication between spool recirculation passages 120 and spool advance passages 118 as shown in FIGS. 6A and 6C. However, torque reversals of camshaft 14 that tend to pressurize oil within retard chambers 44 are prevented from venting oil from retard chambers 44 because torque reversals that tend to pressurize oil within retard chambers 44, together with recirculation check valve spring 136, cause first recirculation check valve 60 to move away from second recirculation check valve 62 until first recirculation check valve guiding portion 60*b* abuts insert lock pin vent wall 128, thereby preventing fluid communication between spool recirculation passages 120 and spool advance passages 118 as shown in FIG. 6B. Consequently, in the retard position, torque reversals of camshaft 14 cause rotor 20 to rotate relative to stator 18 to cause a retard in timing of camshaft 14 relative to the crankshaft. FIG. 6C is the same as FIG. 6A except the reference numbers have been removed for clarity and arrows representing the path of travel of the oil have been included where arrows S represent oil from oil source 76, arrows R represent oil that is being recirculated for rotating rotor 20 relative to stator 18, and arrows P represent oil that is pressurized to retract lock pin 26 from lock pin seat 68.

Figure 7A:
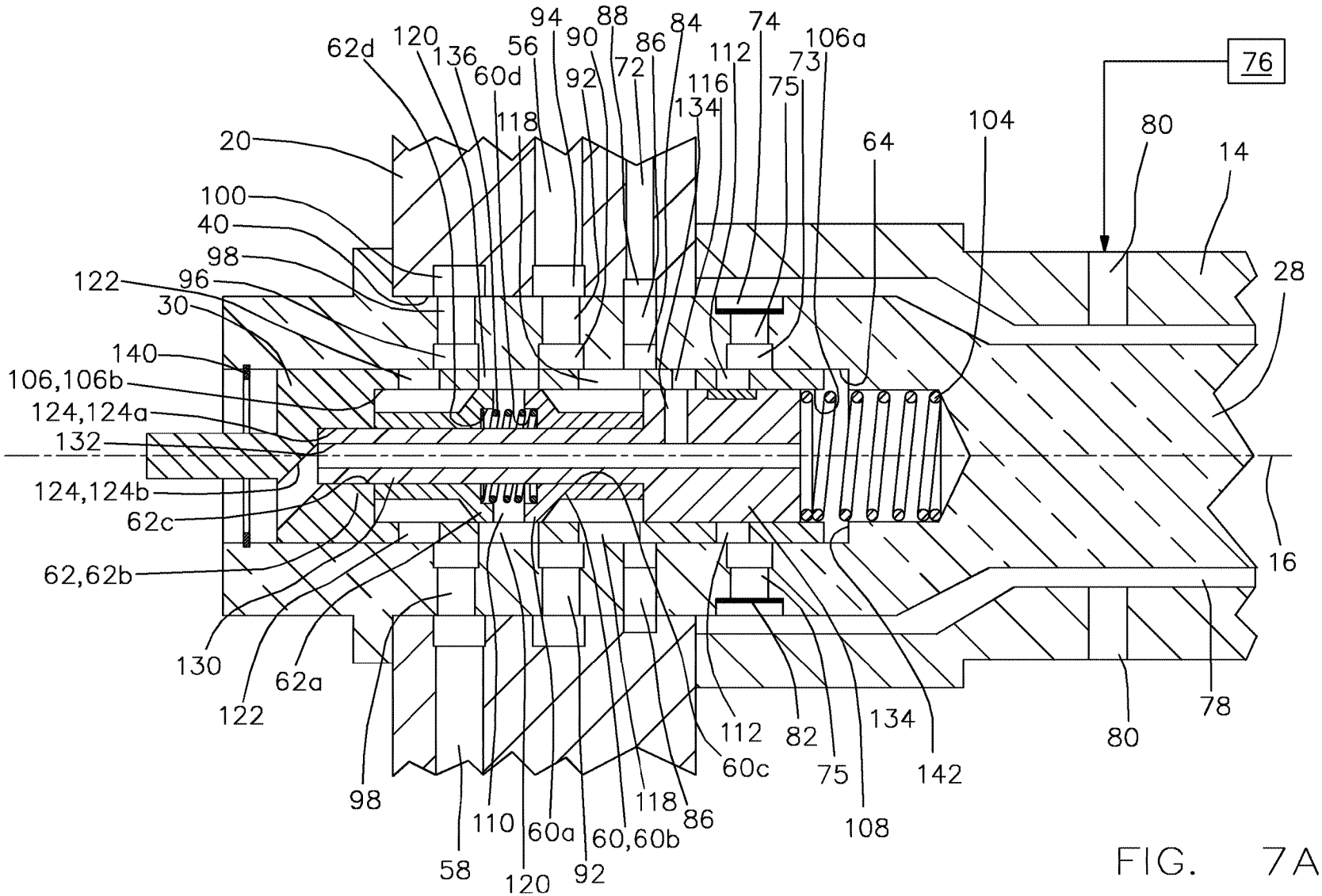
FIG. 7A is the view of FIG. 5A now shown with the valve spool in a hold position.
Figure 7B:
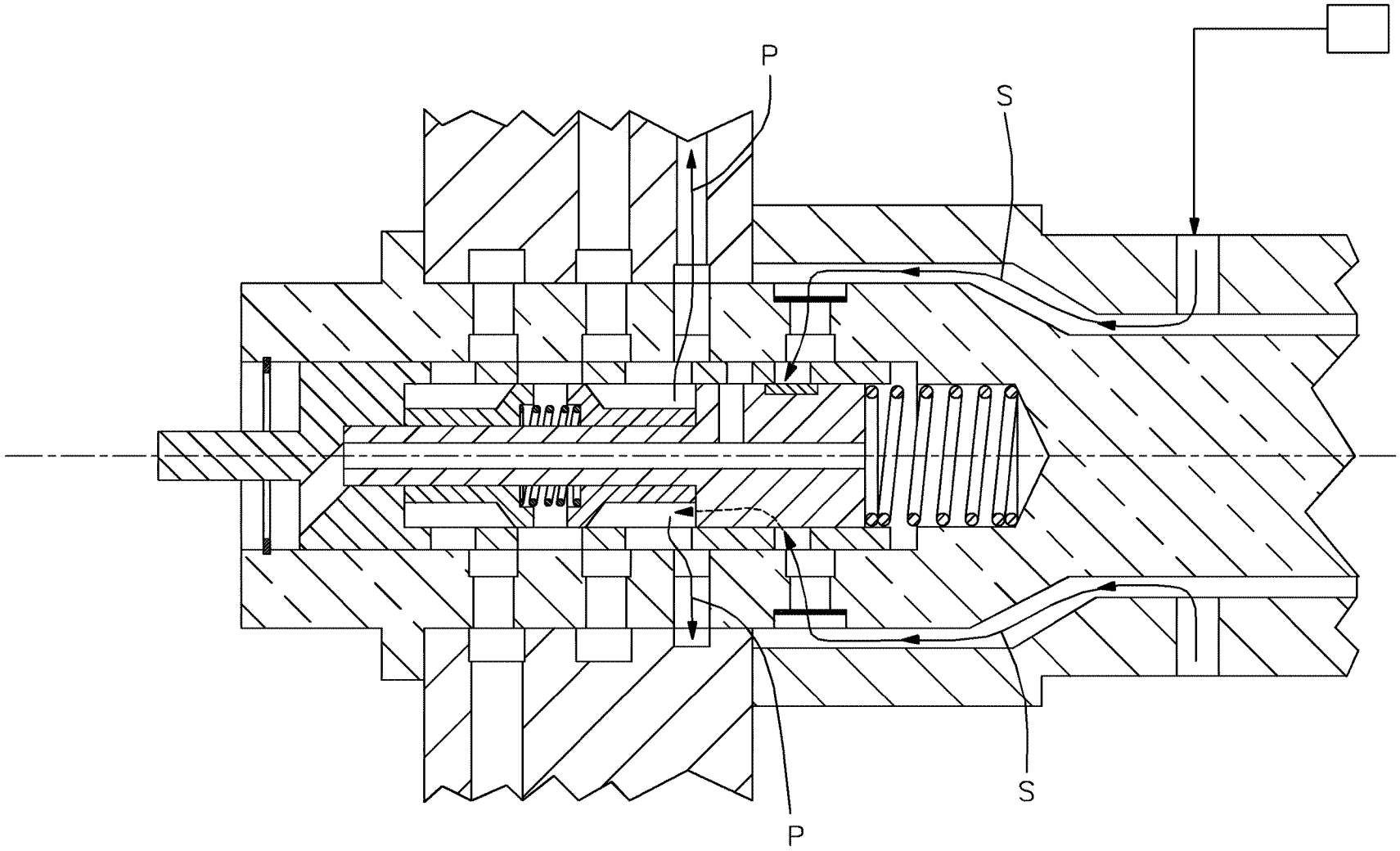
FIG. 7B is the view of FIG. 7A shown with reference numbers removed and arrows added in order to clearly show the path of travel of oil.

In a hold position, when an electric current of a second magnitude is supplied to actuator 102, actuator 102 urges valve spool 30 in a direction toward valve spring 104 as shown in FIGS. 7A-7C, thereby causing valve spring 104 to be compressed slightly more than in the retard position. In the hold position, valve spool 30 is positioned to align spool supply passages 112 with bolt annular inner supply groove 73, thereby allowing pressurized oil to be supplied to phasing volume 110 through supply check valve 114 from oil source 76 when pressure within phasing volume 110 is lower than the pressure of oil source 76. Also in the hold position, valve spool 30 is positioned to block fluid communication between spool lock pin passage 116 and bolt annular lock pin groove 84, thereby preventing oil from being vented from lock pin bore 66. Also in the hold position, valve spool 30 is positioned to align spool advance passages 118 with bolt annular lock pin groove 84, and as a result, lock pin 26 compresses lock pin spring 70 and lock pin 26 is retracted from lock pin seat 68 due to oil supplied to lock pin bore 66 from phasing volume 110. Also in the hold position, valve spool 30 is positioned to prevent fluid communication between bolt annular advance groove 90 and bolt annular retard groove 96, thereby substantially maintaining the rotational position of rotor 20 and stator 18. FIG. 7B is the same as FIG. 7A except the reference numbers have been removed for clarity and arrows representing the path of travel of the oil have been included where arrows S represent oil from oil source 76 and arrows P represent oil that is pressurized to retract lock pin 26 from lock pin seat 68.

In an advance position, when an electric current of a third magnitude is supplied to actuator 102, actuator 102 urges valve spool 30 in a direction toward valve spring 104 as shown in FIGS. 8A-8C, thereby causing valve spring 104 to be compressed slightly more than in the hold position until valve spool 30 abuts a second stop member 142, which may be, by way of non-limiting example only, a shoulder formed in valve bore 64. In the advance position, valve spool 30 is positioned to align spool supply passages 112 with bolt annular inner supply groove 73, thereby allowing pressurized oil to be supplied to phasing volume 110 through supply check valve 114 from oil source 76 when pressure within phasing volume 110 is lower than the pressure of oil source 76. Also in the advance position, valve spool 30 is positioned to block fluid communication between spool lock pin passage 116 and bolt annular lock pin groove 84, thereby preventing oil from being vented from lock pin bore 66. Also in the advance position, valve spool 30 is positioned to align spool advance passages 118 with bolt annular lock pin groove 84, and as a result, lock pin 26 compresses lock pin spring 70 and lock pin 26 is retracted from lock pin seat 68 due to oil supplied to lock pin bore 66 from phasing volume 110. Also in the advance position, valve spool 30 is positioned to prevent fluid communication between phasing volume 110 and bolt annular advance groove 90 through spool advance passages 118. Also in the advance position, valve spool 30 is positioned to align spool recirculation passages 120 with bolt annular advance groove 90, thereby allowing fluid communication between phasing volume 110 and advance chambers 42. Also in the advance position, valve spool 30 is positioned to align spool retard passages 122 with bolt annular retard groove 96, thereby allowing fluid communication between phasing volume 110 and retard chambers 44; however, fluid communication directly between spool recirculation passages 120 and bolt annular retard groove 96 is blocked. In this way, torque reversals of camshaft 14 that tend to pressurize oil within retard chambers 44 cause oil to be vented out of retard chambers 44 and to be supplied to advance chambers 42 via rotor retard passages 58, rotor annular retard groove 100, bolt retard passages 98, bolt annular retard groove 96, spool retard passages 122, phasing volume 110, spool recirculation passages 120, bolt annular advance groove 90, bolt advance passages 92, rotor annular advance groove 94, and rotor advance passages 56. It should be noted that torque reversals of camshaft 14 that tend to pressurize oil within retard chambers 44 cause second recirculation check valve 62 to move toward first recirculation check valve 60, thereby compressing recirculation check valve spring 136 and causing second recirculation check valve sealing portion 62*a* to permit fluid communication between spool recirculation passages 120 and spool retard passages 122 as shown in FIGS. 8A and 8C. However, torque reversals of camshaft 14 that tend to pressurize oil within advance chambers 42 are prevented from venting oil from advance chambers 42 because torque reversals that tend to pressurize oil within advance chambers 42, together with recirculation check valve spring 136, cause second recirculation check valve 62 to move away from first recirculation check valve 60 until second recirculation check valve guiding portion 62*b* abuts the end of valve spool 30 which defines valve spool bore closed end 106*b*, thereby preventing fluid communication between spool recirculation passages 120 and spool retard passages 122 as shown in FIG. 8B. Consequently, in the advance position, torque reversals of camshaft 14 cause rotor 20 to rotate relative to stator 18 to cause an advance in timing of camshaft 14 relative to the crankshaft. FIG. 8C is the same as FIG. 8A except the reference numbers have been removed for clarity and arrows representing the path of travel of the oil have been included where arrows S represent oil from oil source 76, arrows R represent oil that is being recirculated for rotating rotor 20 relative to stator 18, and arrows P represent oil that is pressurized to retract lock pin 26 from lock pin seat 68.

An alternative arrangement in accordance with the invention will now be described where valve spool 30, first recirculation check valve 60, second recirculation check valve 62, insert 108, supply check valve 114, and recirculation check valve spring 136 are substituted with a valve spool 230, a first recirculation check valve 260, a second recirculation check valve 262, an insert 308, a supply check valve 314, and a recirculation check valve spring 336 respectively.

Valve spool 230 includes a valve spool bore 306 extending axially thereinto from the end of valve spool 230 that is proximal to camshaft 14. However, unlike valve spool bore 106 which is coaxial with valve bore 64, the center of valve spool bore 306 is laterally offset from camshaft axis 16, but parallel to camshaft axis 16. Valve spool bore 306 is defined by a valve spool bore open end 306*a* that is proximal to camshaft 14 and a valve spool bore closed end 306*b* that is distal from camshaft 14. Insert 308 is disposed within valve spool bore 306 such that insert 308 sealingly engages the inner periphery of valve spool bore open end 306*a*, thereby defining a phasing volume 310 axially between valve spool bore open end 306*a* and valve spool bore closed end 306*b* within which first recirculation check valve 260 and second recirculation check valve 262 are disposed as will be described in greater detail later.

Valve spool 230 also includes a spool vent passage 324 which extends axially through valve spool 230 such that spool vent passage 324 may be substantially parallel to valve spool bore 306. Spool vent passage 324 opens to each axial end of valve spool 230, thereby providing fluid communication between the bottom of valve bore 64 and the open end of valve bore 64.

Valve spool 230 also includes a spool supply bore 325 which extends axially part way into valve spool 230. However; a supply passage plug 325*a* is sealingly disposed at the end of spool supply bore 325 that is proximal to valve spool bore open end 306*a*. In this way, oil is prevented from entering or exiting spool supply bore 325 from either axial end of spool supply bore 325. As shown, spool supply bore 325 may be substantially parallel to valve spool bore 306 and spool vent passage 324.

Figure 15A:
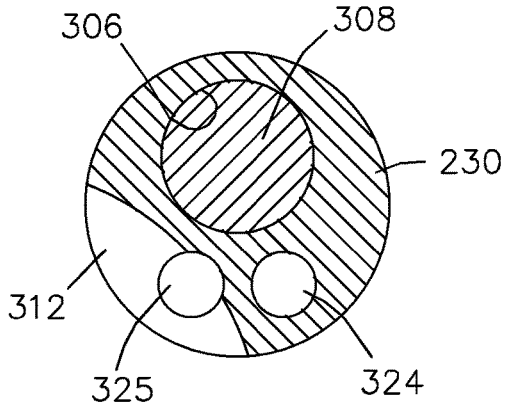
FIGS. 15A-15E are radial cross-sectional views of the alternative valve spool and a valve spool insert of the camshaft phaser in accordance with the present invention showing passages in and out of the alternative valve spool.

Valve spool 230 also includes a spool supply passage 312 which extends radially inward from the out periphery of valve spool 230 to spool supply bore 325, thereby providing fluid communication between bolt annular inner supply groove 73 and spool supply bore 325 when valve spool 230 is positioned within valve bore 64 to align spool supply passage 312 with bolt annular inner supply groove 73. However, it should be noted that spool supply passage 312 does not extend into spool vent passage 324 or into valve spool bore 306 as may be most clearly seen in FIG. 15A which is a radial cross-section view of valve spool 230 and insert 308 taken through spool supply passage 312. Spool supply passage 312 is preferably a slot which extends in a circumferential direction further than in the direction of camshaft axis 16. Supply check valve 314, which may take the form of a ball, is disposed within one bolt supply passage 75 while the other bolt supply passage 75 is plugged with a bolt supply passage plug 75*a*, in order to allow oil to enter spool supply bore 325 from bolt supply passage 75 while substantially preventing oil from back-flowing through bolt supply passage 75.

Figure 15B:
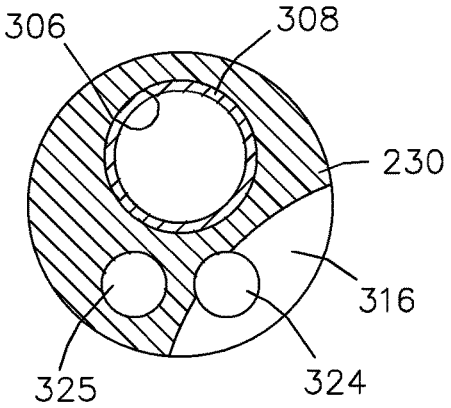

Valve spool 230 also includes a spool lock pin passage 316 which extends radially inward from the outer periphery of valve spool 230 to spool vent passage 324, thereby providing fluid communication between bolt annular lock pin groove 84 and spool vent passage 324 when valve spool 230 is positioned within valve bore 64 to align spool lock pin passage 316 with bolt annular lock pin groove 84. However, it should be noted that spool lock pin passage 316 does not extend into spool supply bore 325 or into valve spool bore 306 as may be most clearly seen in FIG. 15B which is a radial cross-section view of valve spool 230 and insert 308 taken through spool lock pin passage 316. Spool lock pin passage 316 is preferably a slot which extends in a circumferential direction further than in the direction of camshaft axis 16. Spool lock pin passage 316 is spaced axially from spool supply passage 312 such that spool supply passage 312 is axially between valve spool bore open end 306*a* and spool lock pin passage 316.

Figure 15C:
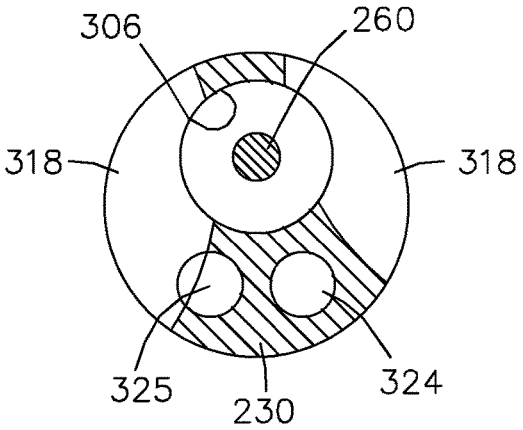

Valve spool 230 also includes spool advance passages 318 which extend inward from the out periphery of valve spool 230 to valve spool bore 306. One spool advance passage 318 also extends inward from the outer periphery of valve spool 230 to spool supply bore 325 as may be most clearly seen in FIG. 15C which is a radial cross-section view of valve spool 230 and first recirculation check valve 260 taken through spool advance passages 318. In this way, fluid communication is provided between bolt annular advance groove 90 and valve spool bore 306 and also between bolt annular advance groove 90 and spool supply bore 325 when valve spool 230 is positioned within valve bore 64 to align spool advance passages 318 with bolt annular advance groove 90 and also thereby providing fluid communication between bolt annular lock pin groove 84 and valve spool bore 306 and between bolt annular lock pin groove 84 and spool supply bore 325 when valve spool 230 is positioned within valve spool bore 106 to align spool advance passages 318 with bolt annular lock pin groove 84. However, it should be noted that neither of spool advance passages 318 extend into spool vent passage 324. Spool advance passages 318 are both preferably slots which extend in a circumferential direction further than in the direction of camshaft axis 16. Spool advance passages 318 are spaced axially from spool lock pin passage 316 such that spool lock pin passage 316 is axially between spool supply passage 312 and spool advance passages 318.

Figure 15D:
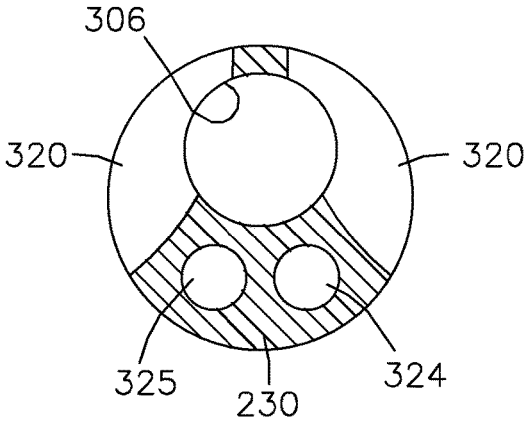

Valve spool 230 also includes spool recirculation passages 320 which extend radially inward from the out periphery of valve spool 230 to valve spool bore 306, thereby providing fluid communication between bolt annular advance groove 90 and valve spool bore 306 when valve spool 230 is positioned within valve bore 64 to align spool recirculation passages 320 with bolt annular advance groove 90 and also thereby providing fluid communication between bolt annular retard groove 96 and valve spool bore 306 when valve spool 230 is positioned within valve bore 64 to align spool recirculation passages 320 with bolt annular retard groove 96. However, it should be noted that neither of spool recirculation passages 320 extend into spool vent passage 224 or spool supply bore 225 as may be most clearly seen in FIG. 15D which is a radial cross-section view of valve spool 230 taken through spool recirculation passages 320. Spool recirculation passages 320 are both preferably slots which extend in a circumferential direction further than in the direction of camshaft axis 16. Spool recirculation passages 320 are spaced axially from spool advance passages 318 such that spool advance passages 318 are axially between spool lock pin passage 316 and spool recirculation passages 320.

Figure 15E:
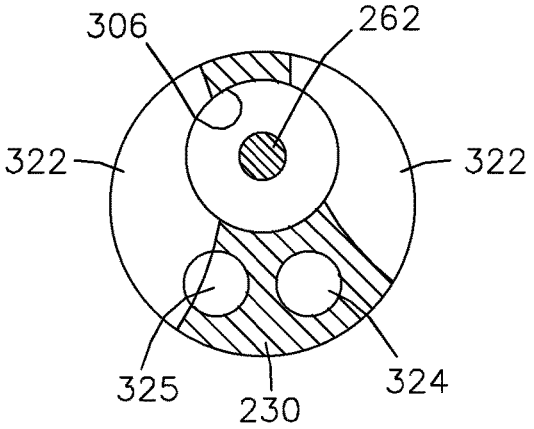

Valve spool 230 also includes spool retard passages 322 which extend radially inward from the out periphery of valve spool 230 to valve spool bore 306. One spool retard passage 322 also extends inward from the outer periphery of valve spool 230 to spool supply bore 325 as may be most clearly seen in FIG. 15E which is a radial cross-section view of valve spool 230 and second recirculation check valve 262 taken through spool retard passages 322. In this way, fluid communication is provided between bolt annular retard groove 96 and valve spool bore 306 and also between bolt annular retard groove 96 and spool supply bore 325 when valve spool 230 is positioned within valve bore 64 to align spool retard passages 322 with bolt annular retard groove 96. Spool retard passages 322 are both preferably slots which extend in a circumferential direction further than in the direction of camshaft axis 16. Spool retard passages 322 are spaced axially from spool recirculation passages 320 such that spool recirculation passages 320 are axially between spool advance passages 318 and spool retard passages 322.

First recirculation check valve 260 includes a first recirculation check valve sealing portion 260*a* which is cylindrical in shape and coaxial with valve spool bore 306. First recirculation check valve sealing portion 260*a* is sized to mate with valve spool bore 306 in a close sliding fit such that first recirculation check valve 260 is able to freely slide axially within valve spool bore 306 while substantially preventing oil from passing between the interface of valve spool bore 306 and first recirculation check valve sealing portion 260*a*. A first recirculation check valve guiding portion 260*b* is spaced axially from first recirculation check valve sealing portion 260*a* in a direction toward insert 308 such that first recirculation check valve sealing portion 260*a* and first recirculation check valve guiding portion 260*b* are joined by a first recirculation check valve connecting portion 260*c*. First recirculation check valve guiding portion 260*b* is sized to mate with valve spool bore 306 in a close sliding fit such that first recirculation check valve 260 is able to freely slide axially within valve spool bore 306 while preventing radial movement of first recirculation check valve guiding portion 260*b* within valve spool bore 306. First recirculation check valve connecting portion 260*c* is sized to provide radial clearance with valve spool bore 306, and consequently, phasing volume 310 is defined in part circumferentially between first recirculation check valve connecting portion 260*c* and valve spool bore 306. A first recirculation check valve guide bore 260*d* extends axially through first recirculation check valve guiding portion 260*b*, thereby preventing a buildup of pressure between first recirculation check valve guiding portion 260*b* and insert 308 which could prevent or slow the movement of first recirculation check valve 260 toward insert 308. A first recirculation check valve recess 260*e* extends into first recirculation check valve sealing portion 260*a* in a coaxial relationship therewith. The purpose of first recirculation check valve recess 260*e* will be described in greater detail later.

Second recirculation check valve 262 includes a second recirculation check valve sealing portion 262*a* which is cylindrical in shape and coaxial with valve spool bore 306. Second recirculation check valve sealing portion 262*a* is sized to mate with valve spool bore 306 in a close sliding fit such that second recirculation check valve 262 is able to freely slide axially within valve spool bore 306 while substantially preventing oil from passing between the interface of valve spool bore 306 and second recirculation check valve sealing portion 262*a*. A second recirculation check valve guiding portion 262*b* is spaced axially from second recirculation check valve sealing portion 262*a* in a direction toward valve spool bore closed end 306*b* such that second recirculation check valve sealing portion 262*a* and second recirculation check valve guiding portion 262*b* are joined by a second recirculation check valve connecting portion 262*c*. Second recirculation check valve guiding portion 262*b* is sized to mate with valve spool bore 306 in a close sliding fit such that second recirculation check valve 262 is able to freely slide axially within valve spool bore 306 while preventing radial movement of second recirculation check valve guiding portion 262*b* within valve spool bore 306. Second recirculation check valve connecting portion 262*c* is sized to provide radial clearance with valve spool bore 306, and consequently, phasing volume 310 is defined in part circumferentially between second recirculation check valve connecting portion 262*c* and valve spool bore 306. A second recirculation check valve guide bore 262*d* extends axially through second recirculation check valve guiding portion 262*b*, thereby preventing a buildup of pressure between second recirculation check valve guiding portion 262*b* and valve spool bore closed end 306*b* which could prevent or slow the movement of second recirculation check valve 262 toward valve spool bore closed end 306*b*. A second recirculation check valve recess 262*e* extends into second recirculation check valve sealing portion 262*a* in a coaxial relationship therewith. A biasing member, illustrated as recirculation check valve spring 336, is disposed within first recirculation check valve recess 260*e* and second recirculation check valve recess 262*e* such that recirculation check valve spring 336 biases first recirculation check valve 260 and second recirculation check valve 262 away from each other.

Figure 11A:
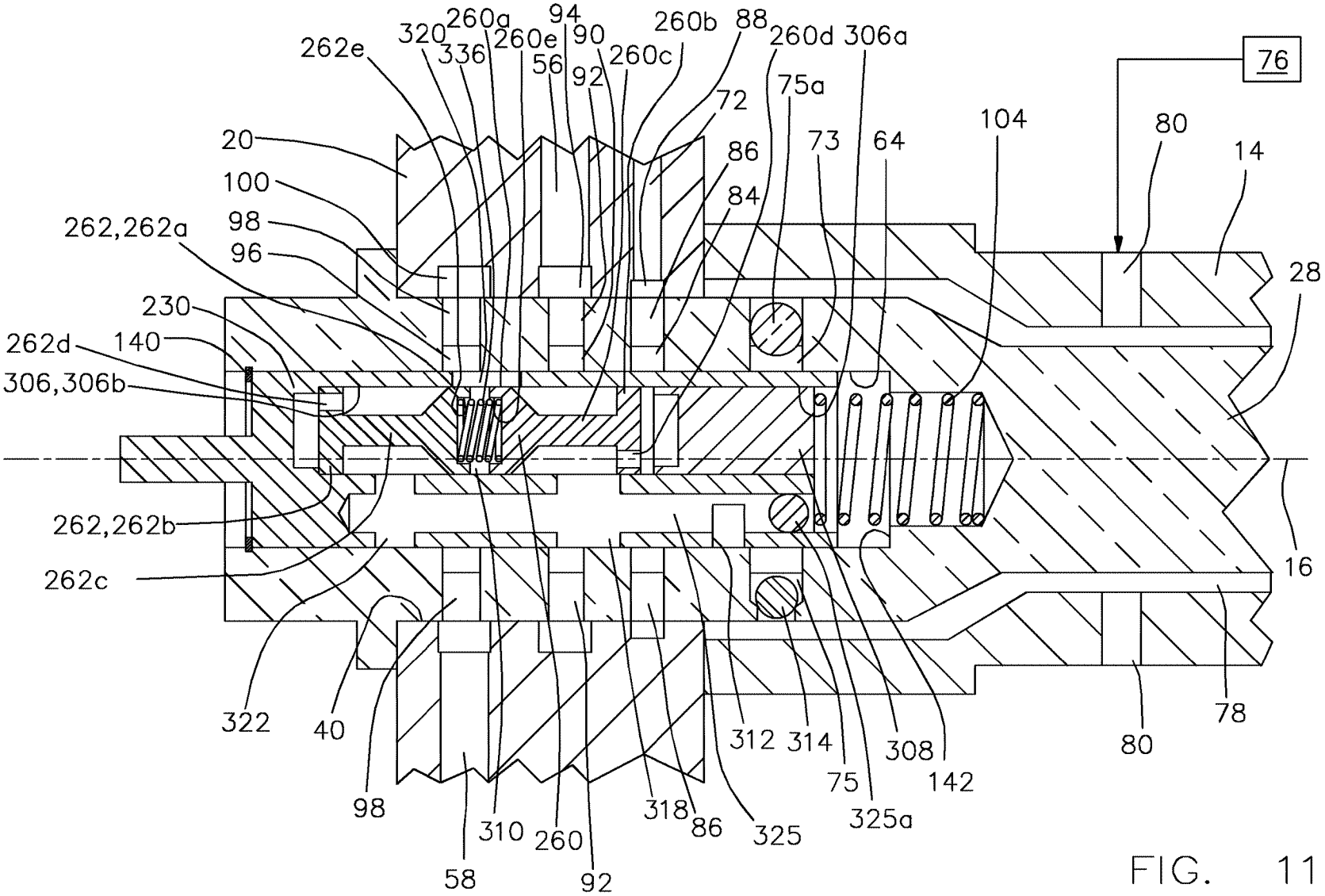
FIGS. 11A and 11B are axial cross-sectional views through different cutting planes showing an alternative valve spool of the camshaft phaser in a default position and a first check valve open.
Figure 11B:
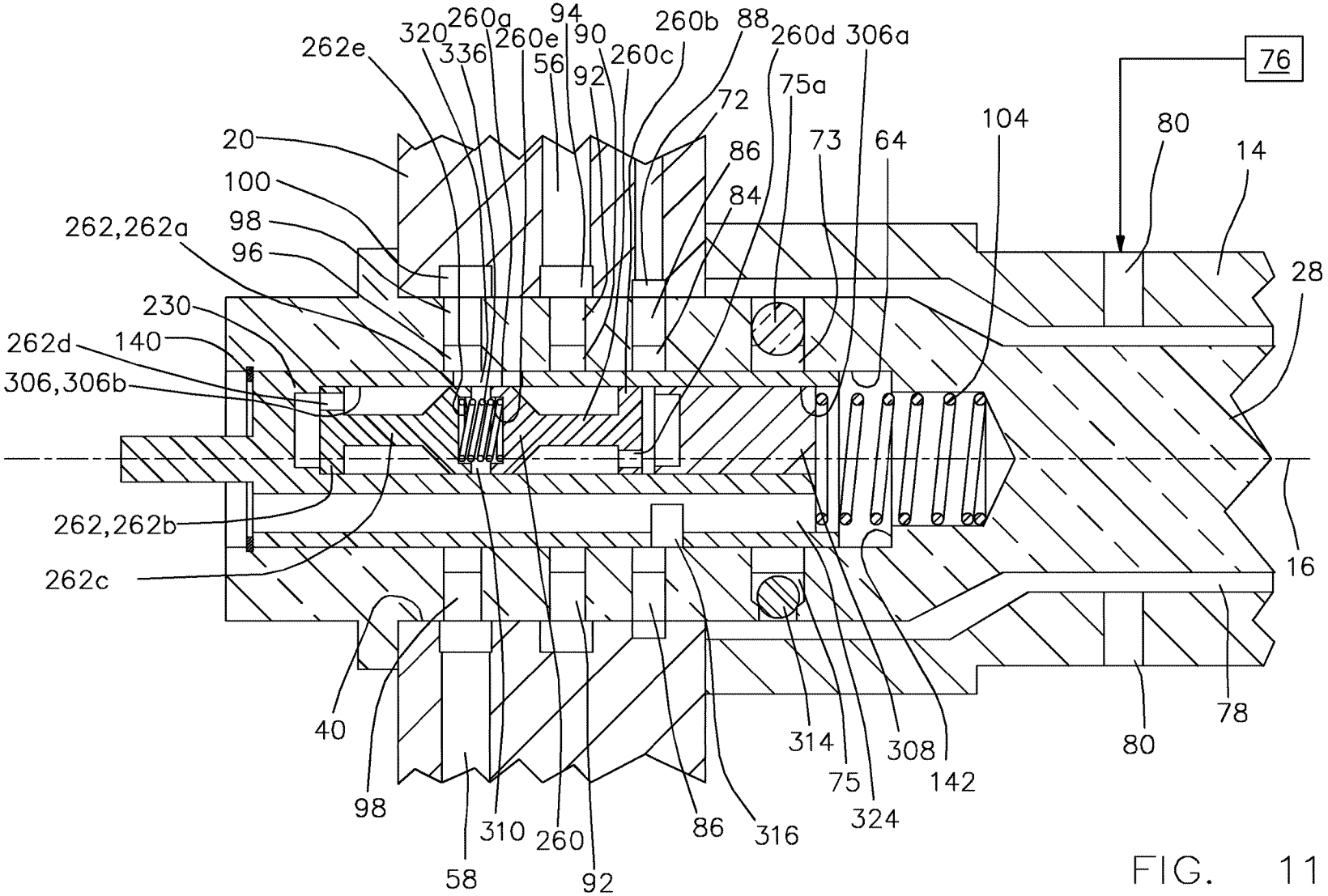
Figure 11C:
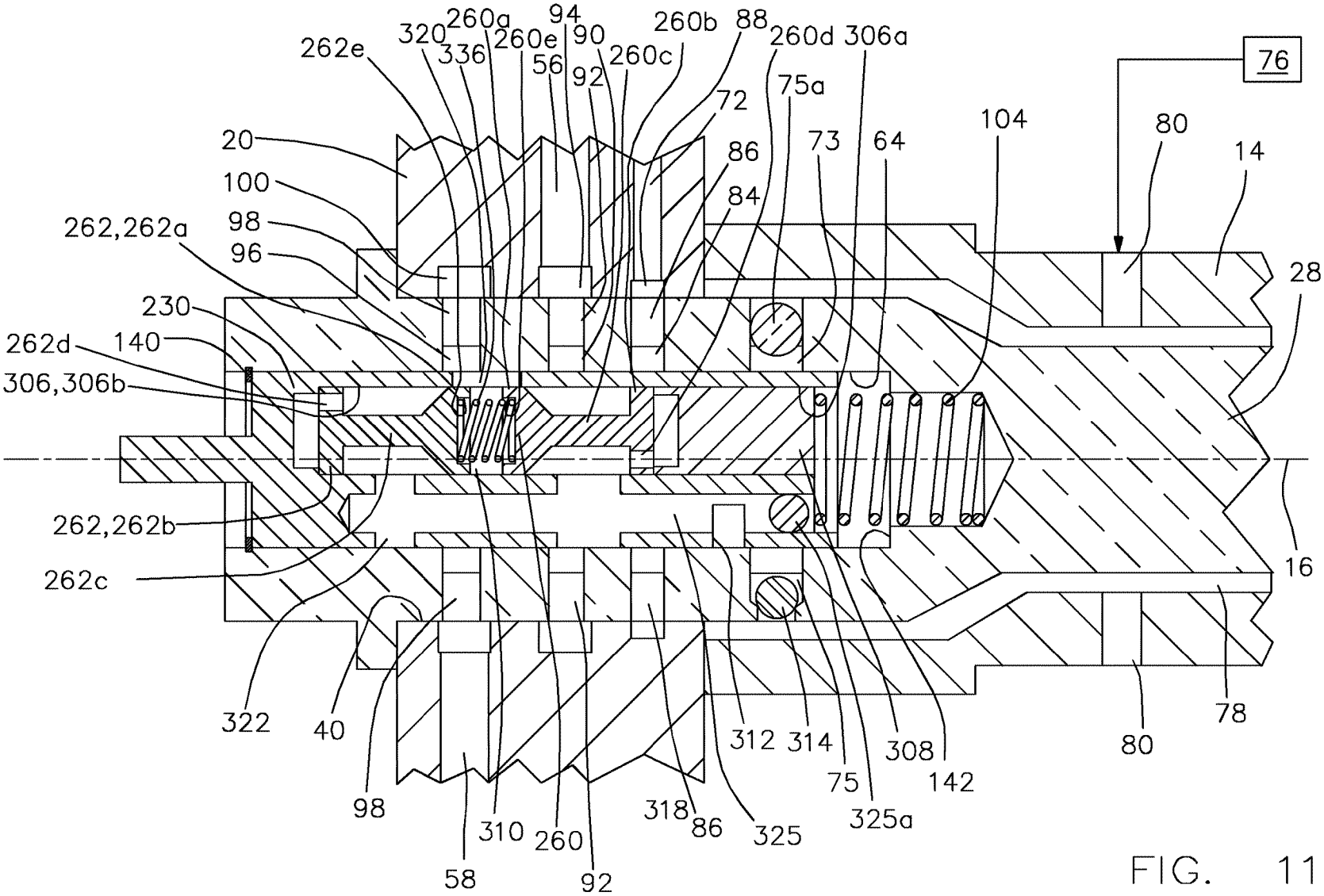
FIGS. 11C and 11D are the views of FIGS. 11A and 11B respectively now with the first check valve closed.
Figure 11D:
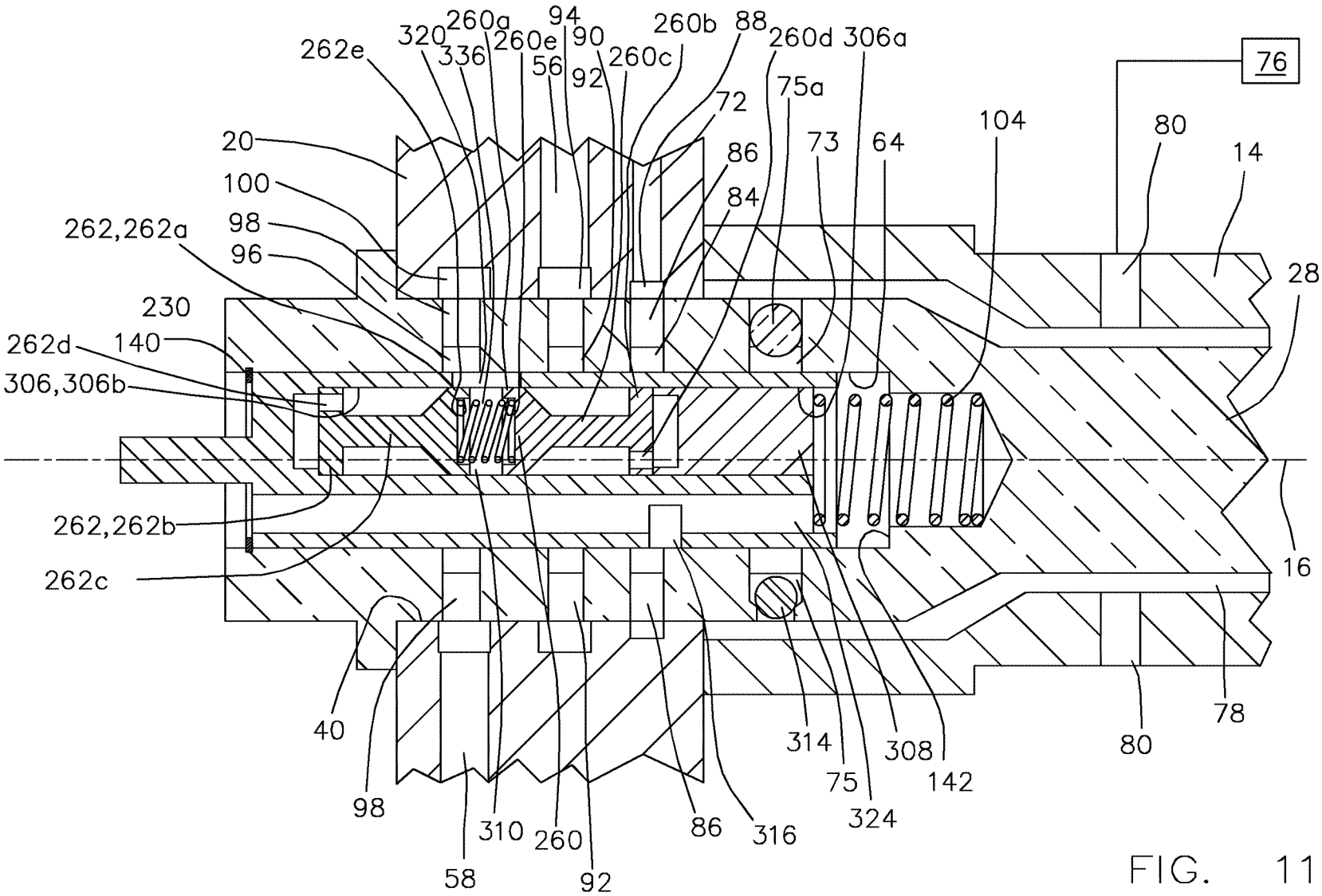
Figure 11E:
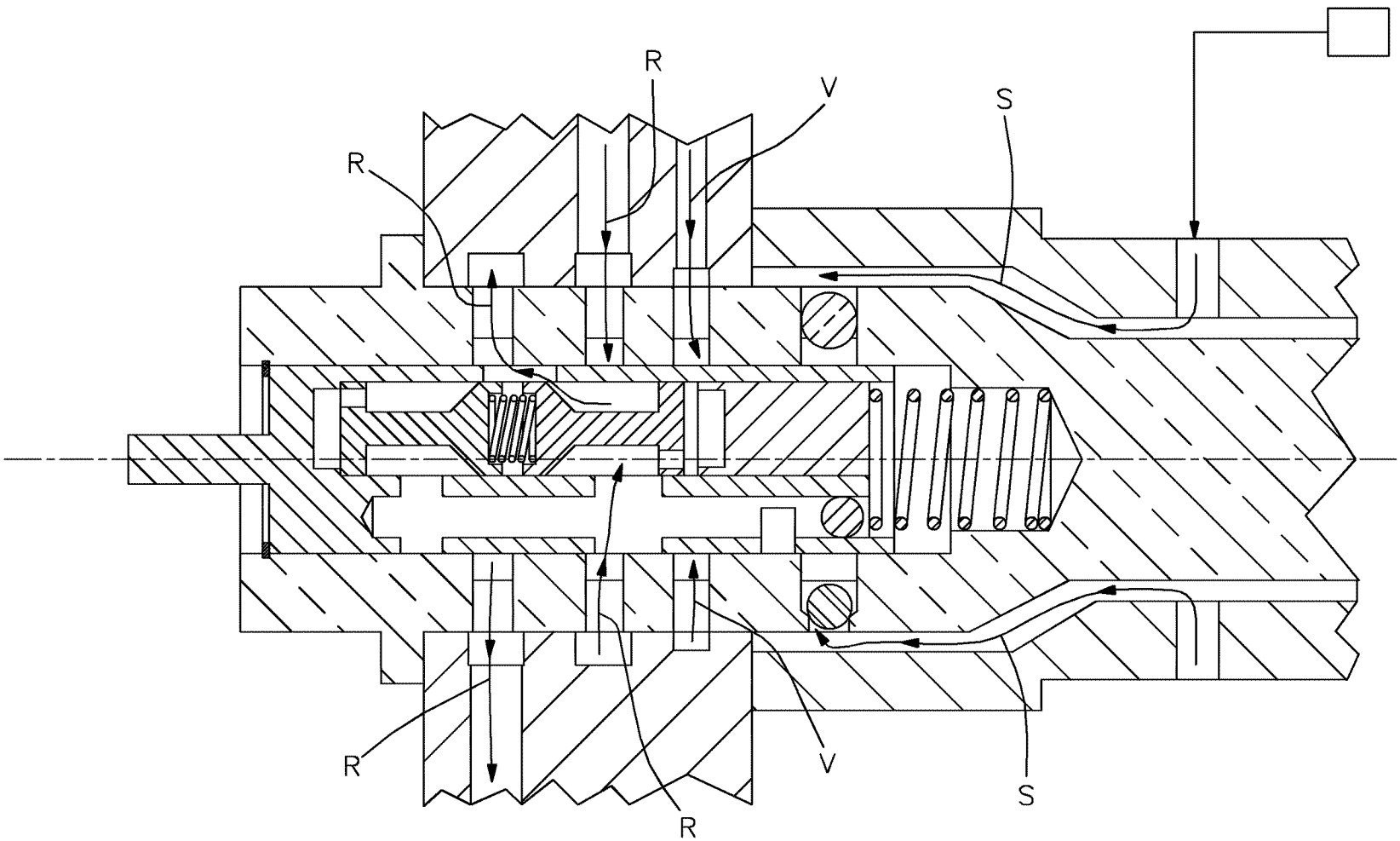
FIGS. 11E and 11F are the views of FIGS. 11A and 11B respectively shown with reference numbers removed in order to clearly shown the path of travel of oil.
Figure 11F:
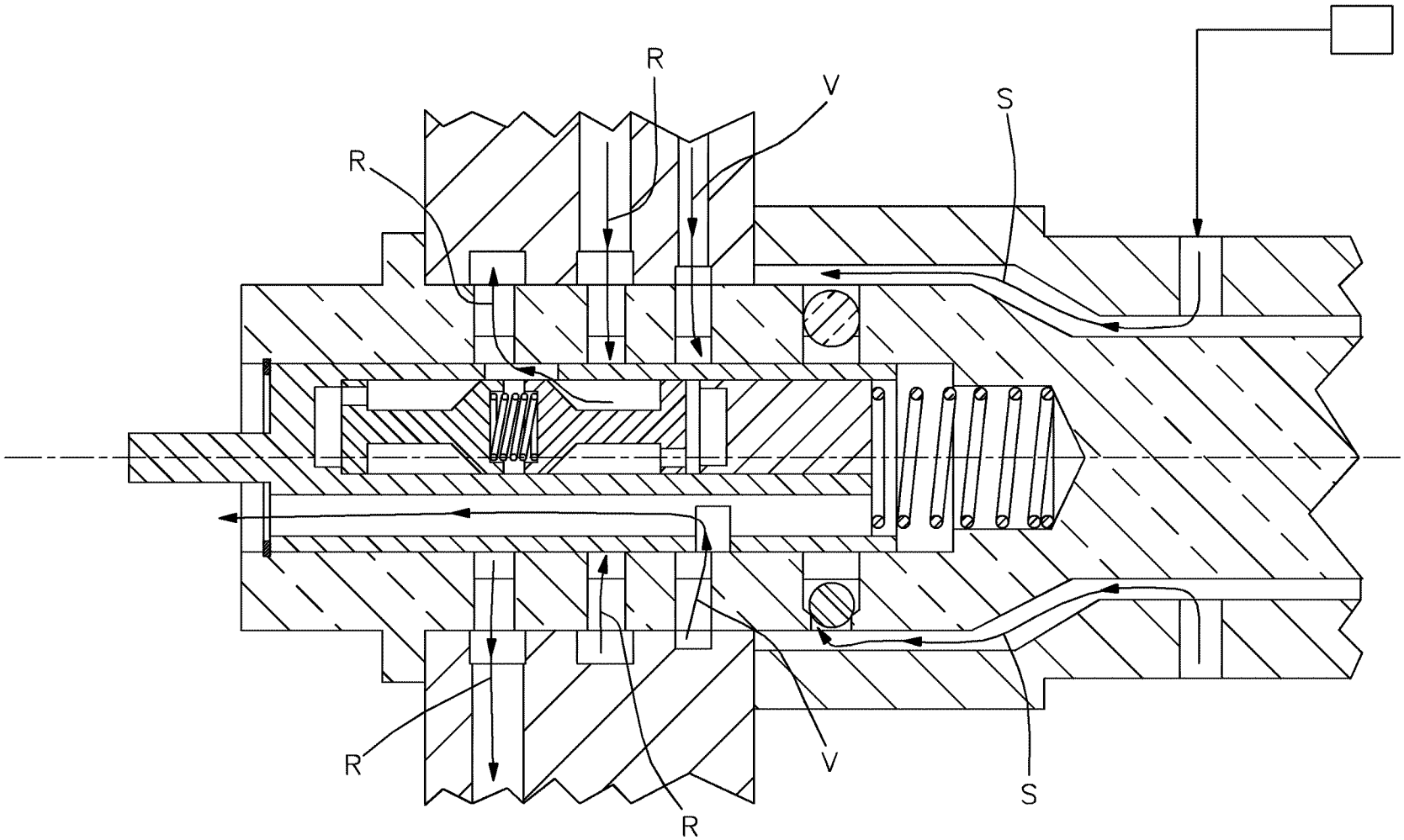

In a default position, when no electric current is supplied to actuator 102, valve spring 104 urges valve spool 230 in a direction toward actuator 102 as shown in FIGS. 11A-11F until valve spool 230 axially abuts first stop member 140. In the default position, valve spool 230 is positioned to block bolt annular inner supply groove 73, thereby preventing pressurized oil from being supplied to phasing volume 310 from oil source 76. Also in the default position, valve spool 230 is positioned to align spool lock pin passage 316 with bolt annular lock pin groove 84, thereby allowing oil to be vented from lock pin bore 66 via rotor lock pin passage 72, rotor annular lock pin groove 88, bolt lock pin passages 86, bolt annular lock pin groove 84, spool lock pin passage 316, and spool vent passage 324 and consequently allowing lock pin spring 70 to urge lock pin 26 toward front cover 24. Also in the default position, valve spool 230 is positioned to block fluid communication between phasing volume 310/spool supply bore 325 and spool lock pin passage 316, thereby preventing oil from being supplied from phasing volume 310/spool supply bore 325 to lock pin bore 66. Also in the default position, valve spool 230 is positioned to align spool advance passages 318 with bolt annular advance groove 90, thereby allowing fluid communication between phasing volume 310/spool supply bore 325 and advance chambers 42; however, fluid communication directly between spool recirculation passages 320 and bolt annular advance groove 90 is blocked. Also in the default position, valve spool 230 is positioned to align spool recirculation passages 320 with bolt annular retard groove 96, thereby allowing fluid communication between phasing volume 310 and retard chambers 44. Also in the default position, valve spool 230 is positioned to block fluid communication between phasing volume 310/spool supply bore 325 and bolt annular retard groove 96 through spool retard passages 322. In this way, torque reversals of camshaft 14 that tend to pressurize oil within advance chambers 42 cause oil to be vented out of advance chambers 42 and to be supplied to retard chambers 44 via rotor advance passages 56, rotor annular advance groove 94, bolt advance passages 92, bolt annular advance groove 90, spool advance passages 318, phasing volume 310, spool recirculation passages 320, bolt annular retard groove 96, bolt retard passages 98, rotor annular retard groove 100, and rotor retard passages 58. It should be noted that torque reversals of camshaft 14 that tend to pressurize oil within advance chambers 42 cause first recirculation check valve 260 to move toward second recirculation check valve 262, thereby compressing recirculation check valve spring 336 and causing first recirculation check valve sealing portion 260*a* to permit fluid communication between spool recirculation passages 320 and spool advance passages 318 as shown in FIGS. 11A and 11B. However, torque reversals of camshaft 14 that tend to pressurize oil within retard chambers 44 are prevented from venting oil from retard chambers 44 because torque reversals that tend to pressurize oil within retard chambers 44, together with recirculation check valve spring 336, cause first recirculation check valve 260 to move away from second recirculation check valve 262 until first recirculation check valve guiding portion 260*b* abuts insert 308, thereby preventing fluid communication between spool recirculation passages 320 and spool advance passages 318 as shown in FIGS. 11C and 11D. Consequently, in the default position, torque reversals of camshaft 14 cause rotor 20 to rotate relative to stator 18 to cause a retard in timing of camshaft 14 relative to the crankshaft, and when lock pin 26 is aligned with lock pin seat 68, lock pin spring 70 urges lock pin 26 into lock pin seat 68 to retain rotor 20 in the predetermined aligned position with stator 18. FIGS. 11E and 11F are the same as FIGS. 11A and 11B respectively except the reference numbers have been removed for clarity and arrows representing the path of travel of the oil have been included where arrows S represent oil from oil source 76, arrows V represent vented oil from lock pin bore 66, and arrows R represent oil that is being recirculated for rotating rotor 20 relative to stator 18.

Figure 12A:
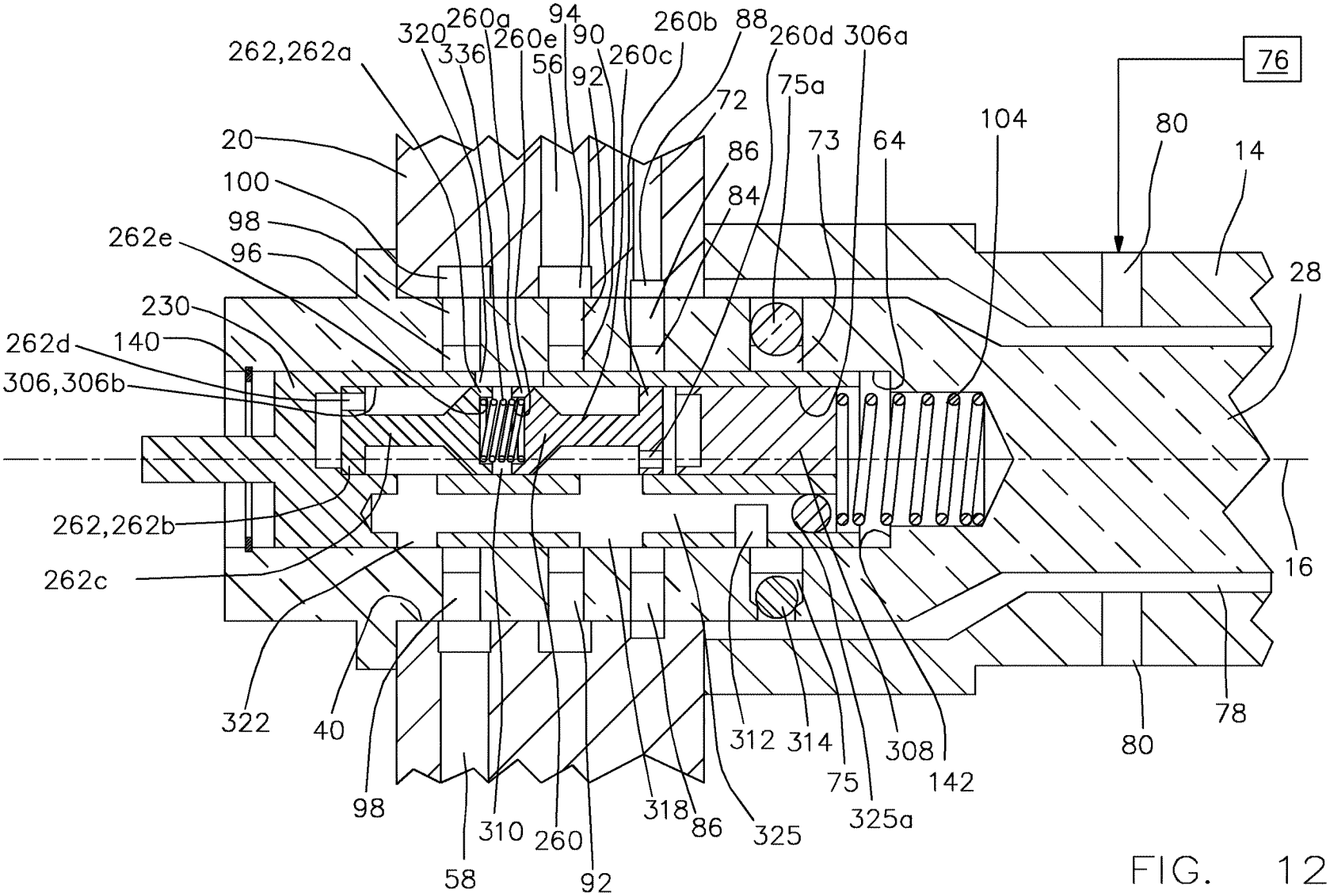
FIGS. 12A and 12B are the views of FIGS. 11A and 11B respectively now shown with the valve spool in a retard position and with the first check valve open.
Figure 12B:
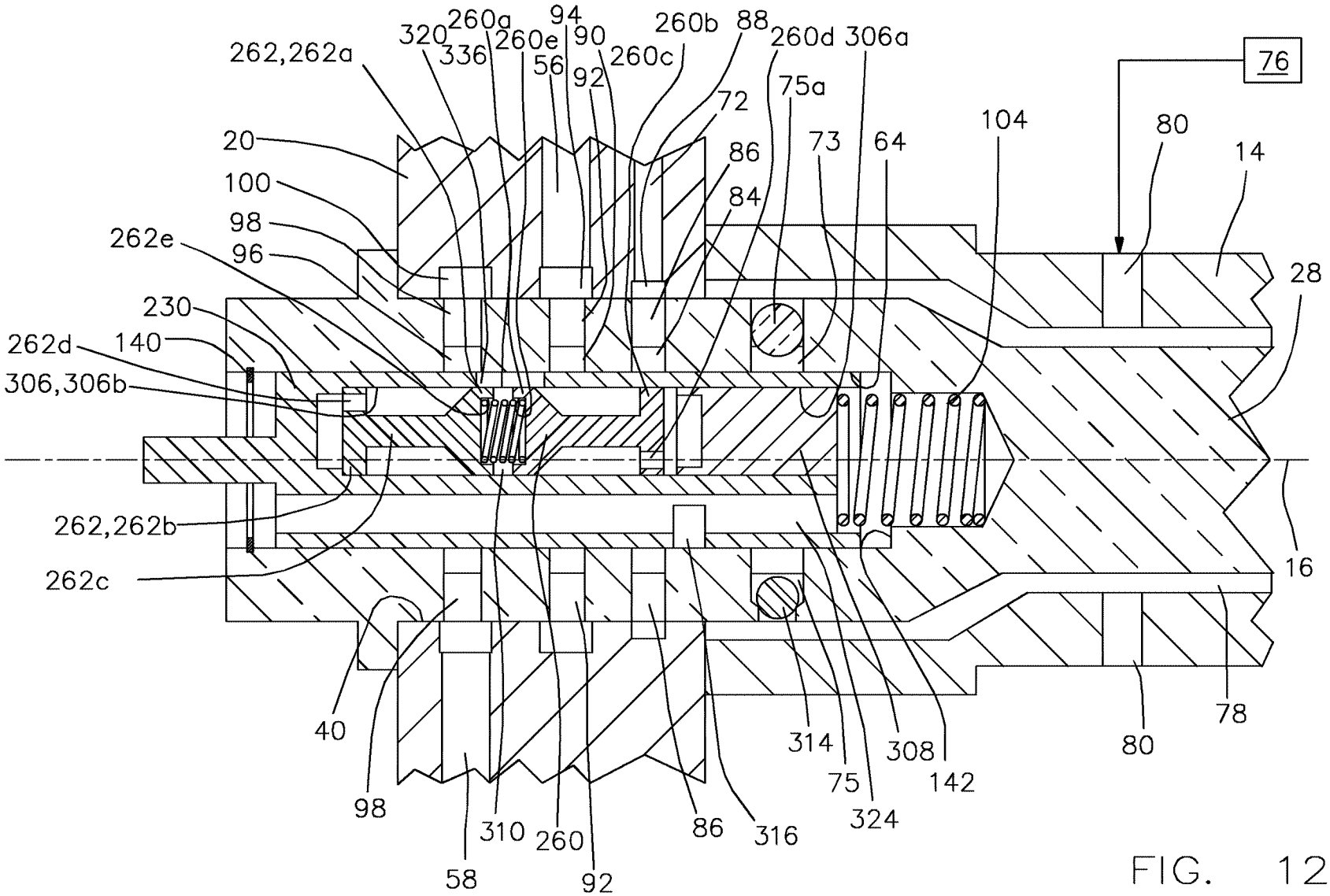
Figure 12C:
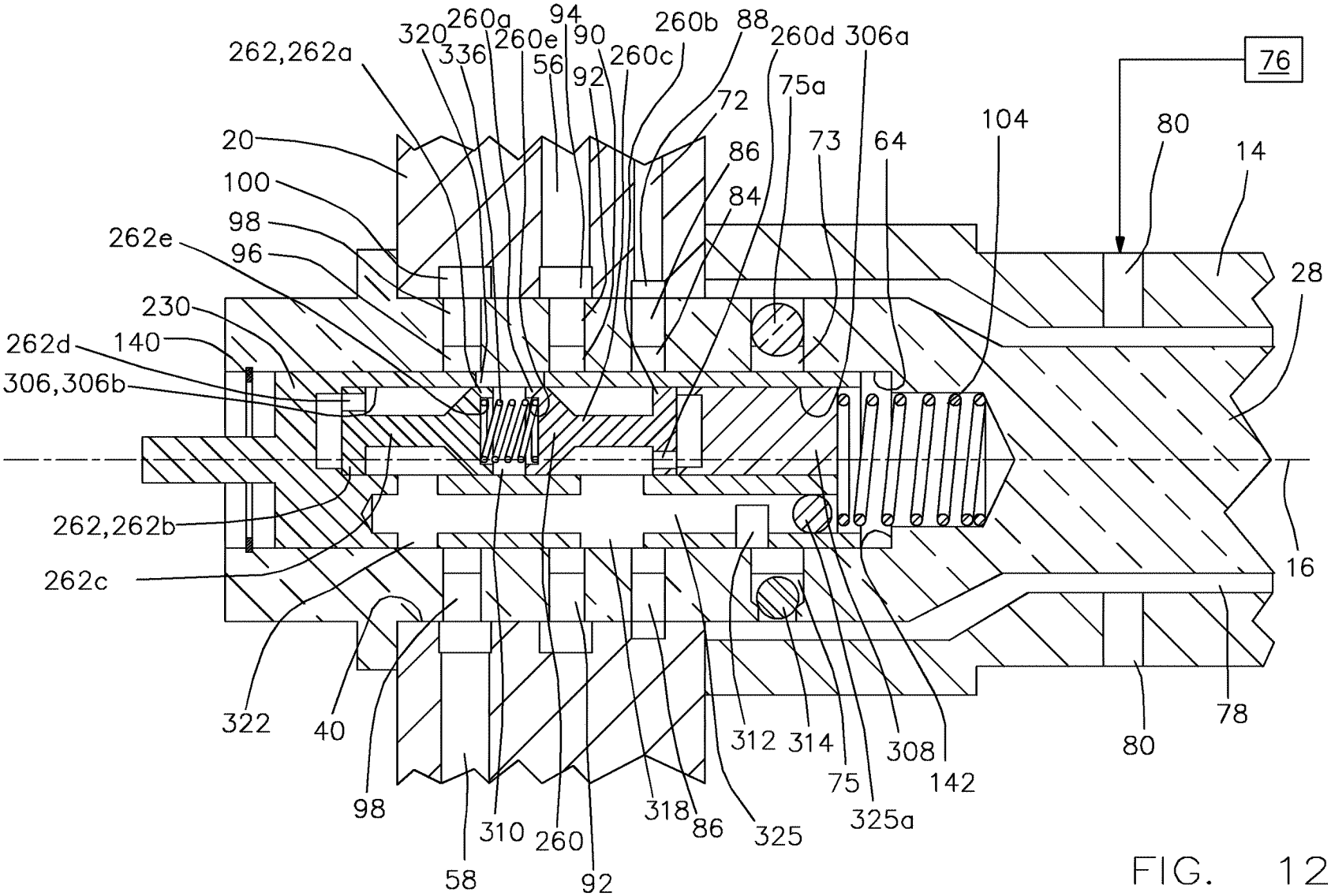
FIGS. 12C and 12D are the view of FIGS. 12A and 12B respectively now with the first check valve closed.
Figure 12D:
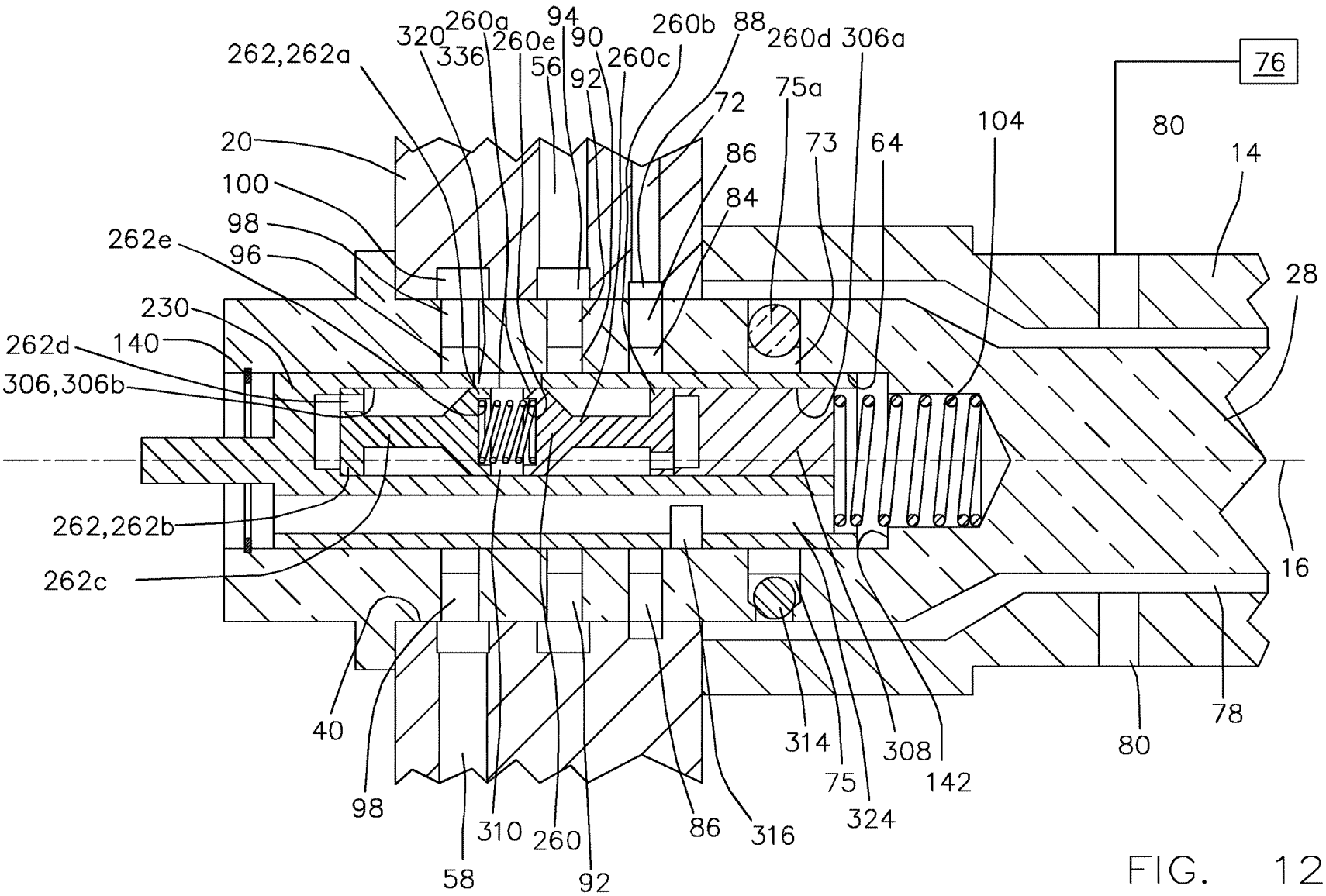
Figure 12E:
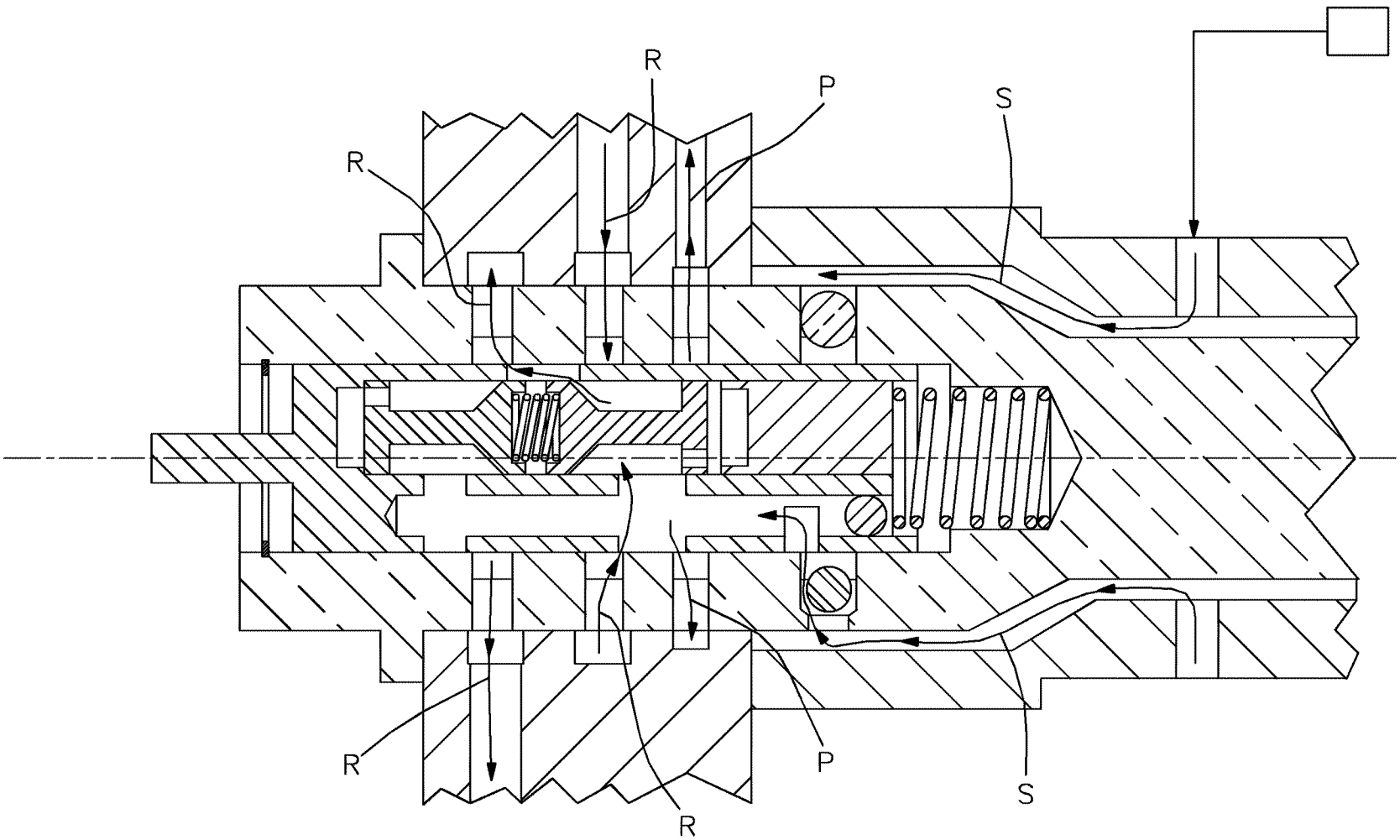
FIG. 12E is the view of FIG. 12A shown with reference numbers removed and arrows added in order to clearly show the path of travel of oil.

In a retard position, when an electric current of a first magnitude is supplied to actuator 102, actuator 102 urges valve spool 230 in a direction toward valve spring 104 as shown in FIGS. 12A-12E, thereby causing valve spring 104 to be compressed slightly. In the retard position, valve spool 230 is positioned to align spool supply passage 312 with bolt annular inner supply groove 73, thereby allowing pressurized oil to be supplied to phasing volume 310 through supply check valve 314 and spool supply bore 325 from oil source 76 when pressure within phasing volume 310 is lower than the pressure of oil source 76. Also in the retard position, valve spool 230 is positioned to block fluid communication between spool lock pin passage 316 and bolt annular lock pin groove 84, thereby preventing oil from being vented from lock pin bore 66. Also in the retard position, valve spool 230 is positioned to align spool advance passages 318 with bolt annular lock pin groove 84, and as a result, lock pin 26 compresses lock pin spring 70 and lock pin 26 is retracted from lock pin seat 68 due to oil supplied to lock pin bore 66 from phasing volume 310/spool supply bore 325. It should be noted that by supplying oil to lock pin bore 66 from phasing volume 310/spool supply bore 325, a separate dedicated supply for retracting lock pin 26 from lock pin seat 68 is not required. Also in the retard position, valve spool 230 is positioned to align spool advance passages 318 with bolt annular advance groove 90, thereby allowing fluid communication between phasing volume 310/spool supply bore 325 and advance chambers 42; however, fluid communication directly between spool recirculation passages 320 and bolt annular advance groove 90 is blocked. Also in the retard position, valve spool 230 is positioned to align spool recirculation passages 320 with bolt annular retard groove 96, thereby allowing fluid communication between phasing volume 310 and retard chambers 44. Also in the retard position, valve spool 230 is positioned to block fluid communication between phasing volume 310/spool supply bore 325 and bolt annular retard groove 96 through spool retard passages 322. In this way, torque reversals of camshaft 14 that tend to pressurize oil within advance chambers 42 cause oil to be vented out of advance chambers 42 and to be supplied to retard chambers 44 via rotor advance passages 56, rotor annular advance groove 94, bolt advance passages 92, bolt annular advance groove 90, spool advance passages 318, phasing volume 310, spool recirculation passages 320, bolt annular retard groove 96, bolt retard passages 98, rotor annular retard groove 100, and rotor retard passages 58. It should be noted that torque reversals of camshaft 14 that tend to pressurize oil within advance chambers 42 cause first recirculation check valve 260 to move toward second recirculation check valve 262, thereby compressing recirculation check valve spring 336 and causing first recirculation check valve sealing portion 260*a* to permit fluid communication between spool recirculation passages 320 and spool advance passages 318 as shown in FIGS. 12A and 12B. However, torque reversals of camshaft 14 that tend to pressurize oil within retard chambers 44 are prevented from venting oil from retard chambers 44 because torque reversals that tend to pressurize oil within retard chambers 44, together with recirculation check valve spring 336, cause first recirculation check valve 260 to move away from second recirculation check valve 262 until first recirculation check valve guiding portion 260*b* abuts insert 308, thereby preventing fluid communication between spool recirculation passages 320 and spool advance passages 318 as shown in FIGS. 12C and 12D. Consequently, in the default position, torque reversals of camshaft 14 cause rotor 20 to rotate relative to stator 18 to cause a retard in timing of camshaft 14 relative to the crankshaft. FIG. 12E is the same as FIG. 12A except the reference numbers have been removed for clarity and arrows representing the path of travel of the oil have been included where arrows S represent oil from oil source 76, arrows R represent oil that is being recirculated for rotating rotor 20 relative to stator 18, and arrows P represent oil that is pressurized to retract lock pin 26 from lock pin seat 68.

Figure 13A:
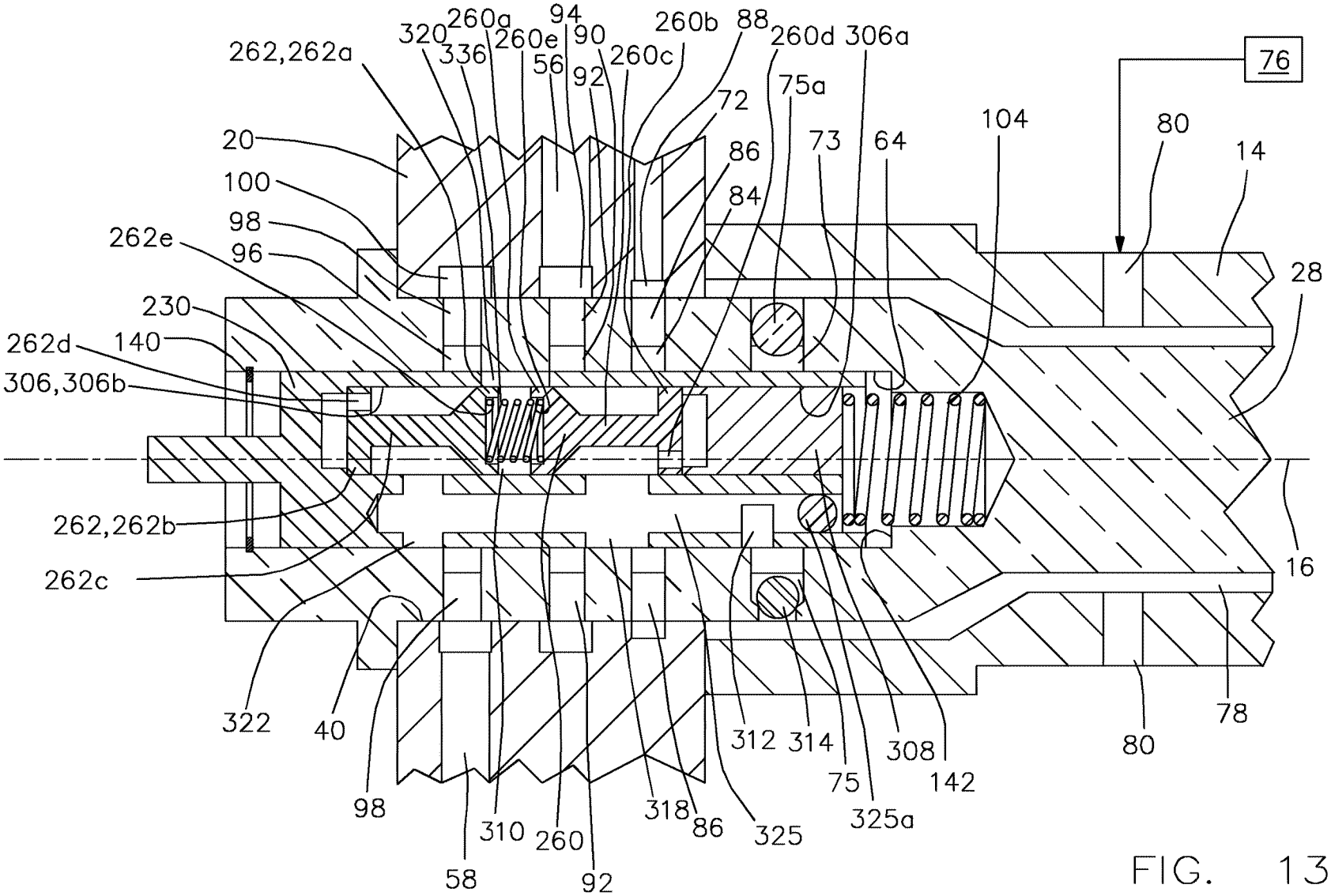
FIGS. 13A and 13B are the views of FIGS. 11A and 11B respectively now shown with the valve spool in a hold position.
Figure 13B:
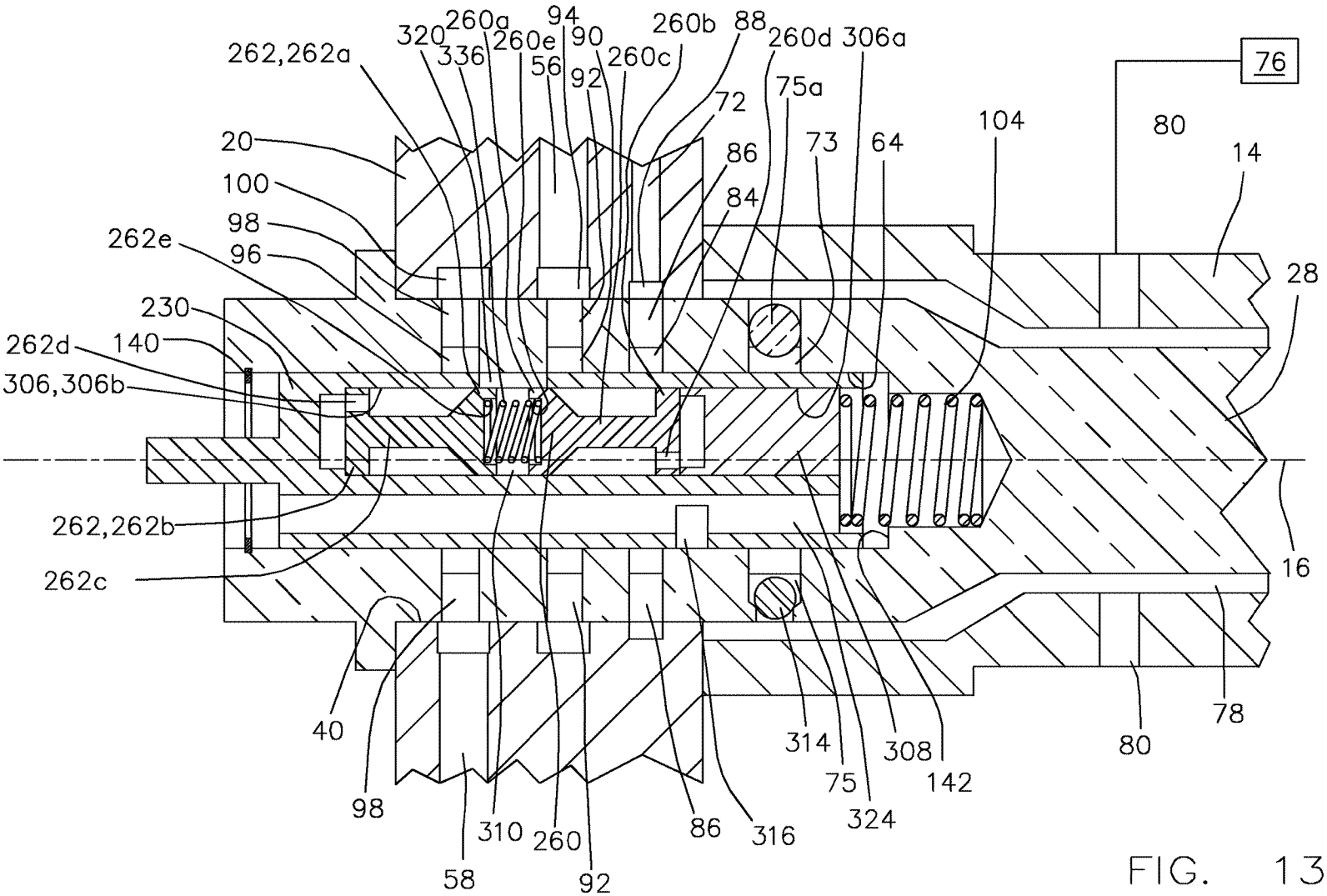
Figure 13C:
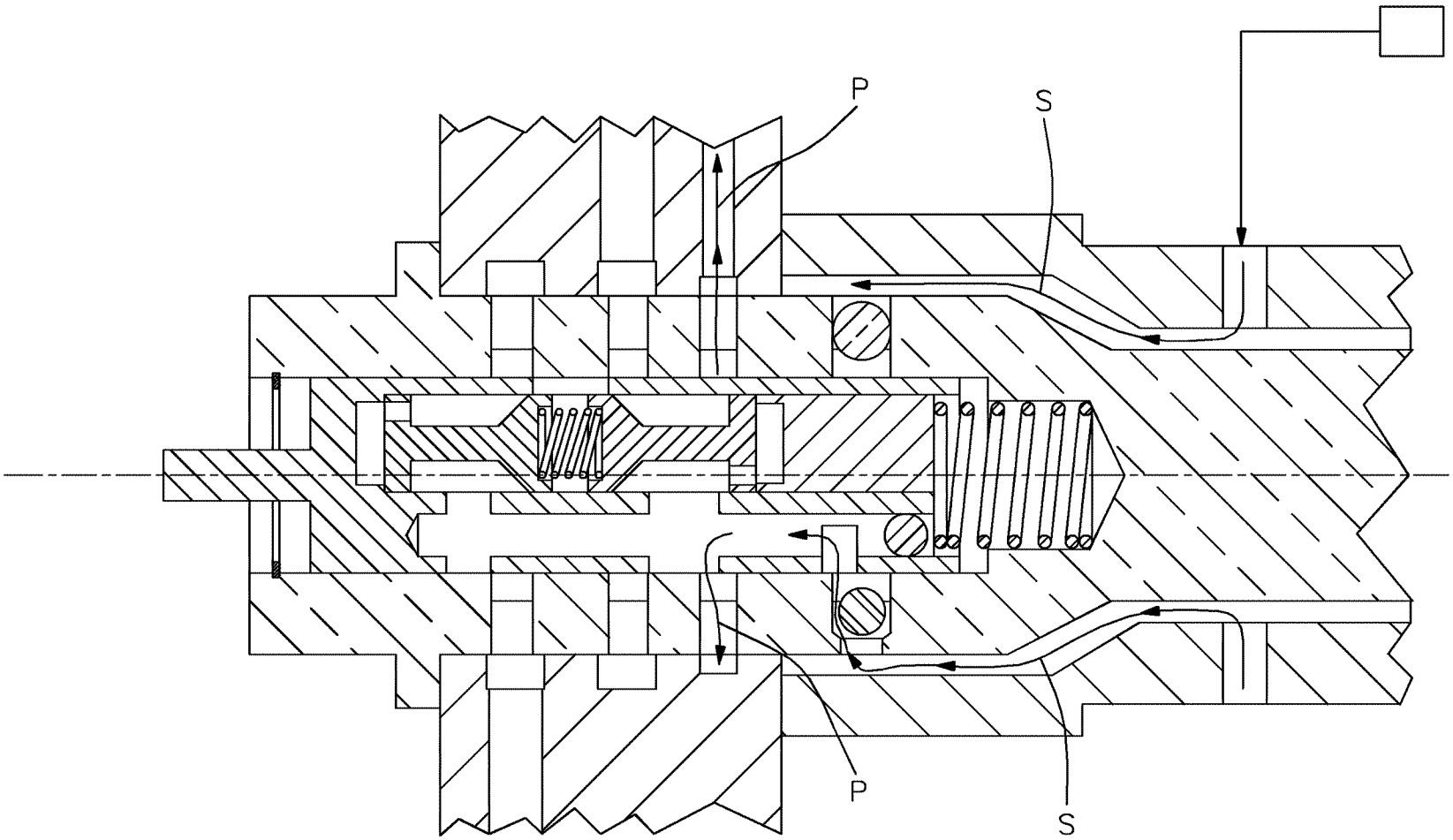
FIG. 13C is the view of FIG. 13A shown with reference numbers removed and arrows added in order to clearly show the path of travel of oil.

In a hold position, when an electric current of a second magnitude is supplied to actuator 102, actuator 102 urges valve spool 230 in a direction toward valve spring 104 as shown in FIGS. 13A-13C, thereby causing valve spring 104 to be compressed slightly more than in the retard position. In the hold position, valve spool 230 is positioned to align spool supply passage 312 with bolt annular inner supply groove 73, thereby allowing pressurized oil to be supplied to phasing volume 310 through supply check valve 314 and spool supply bore 325 from oil source 76 when pressure within phasing volume 310 is lower than the pressure of oil source 76. Also in the hold position, valve spool 230 is positioned to block fluid communication between spool lock pin passage 316 and bolt annular lock pin groove 84, thereby preventing oil from being vented from lock pin bore 66. Also in the hold position, valve spool 230 is positioned to align spool advance passages 318 with bolt annular lock pin groove 84, and as a result, lock pin 26 compresses lock pin spring 70 and lock pin 26 is retracted from lock pin seat 68 due to oil supplied to lock pin bore 66 from phasing volume 310/spool supply bore 325. Also in the hold position, valve spool 230 is positioned to prevent fluid communication between phasing volume 310 and each of bolt annular advance groove 90 and bolt annular retard groove 96, thereby substantially maintaining the rotational position of rotor 20 and stator 18. FIG. 13C is the same as FIG. 13A except the reference numbers have been removed for clarity and arrows representing the path of travel of the oil have been included where arrows S represent oil from oil source 76 and arrows P represent oil that is pressurized to retract lock pin 26 from lock pin seat 68.

Figure 14A:
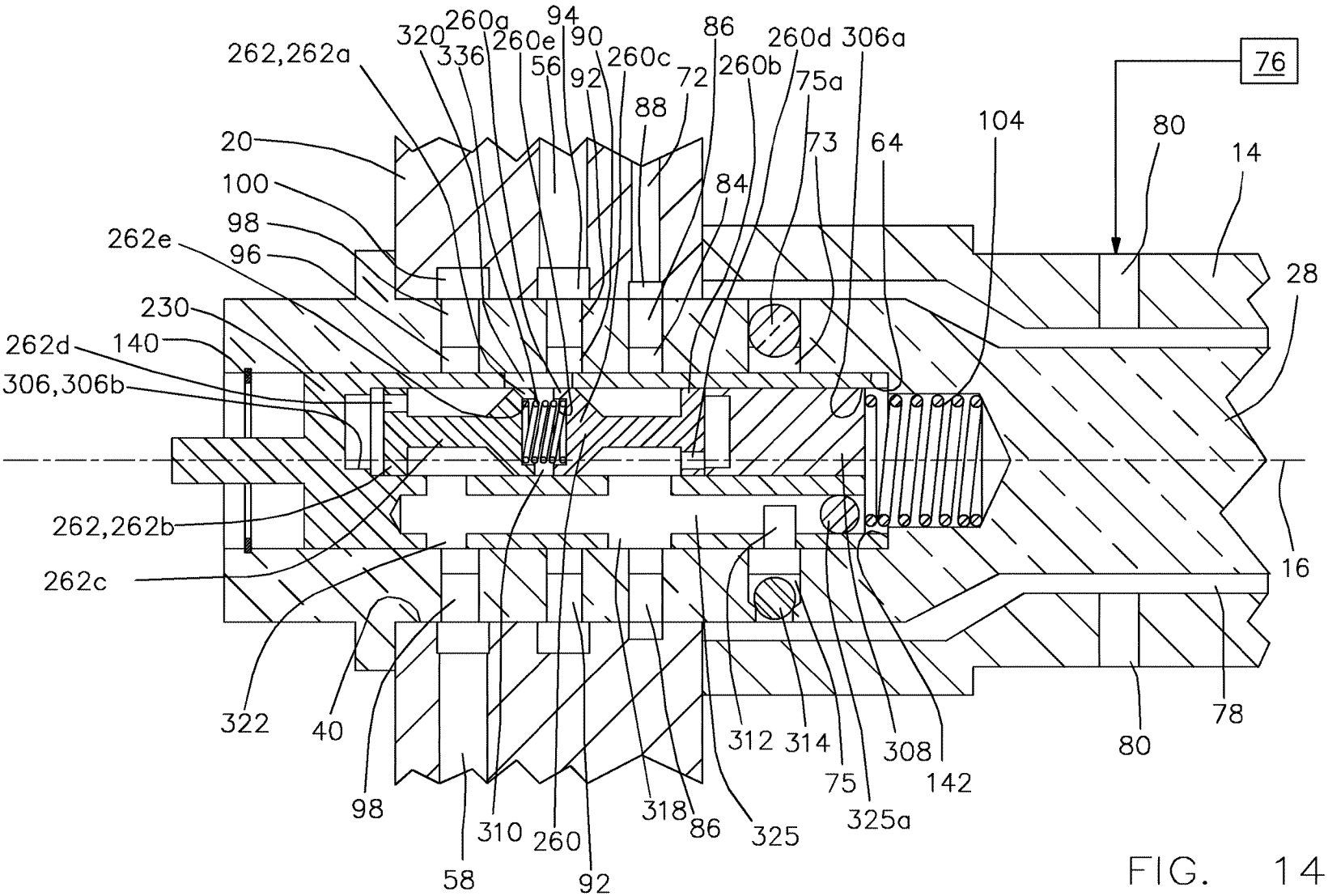
FIGS. 14A and 14B are the views of FIGS. 11A and 11B respectively now shown with the valve spool in an advance position and with a second check valve open.
Figure 14B:
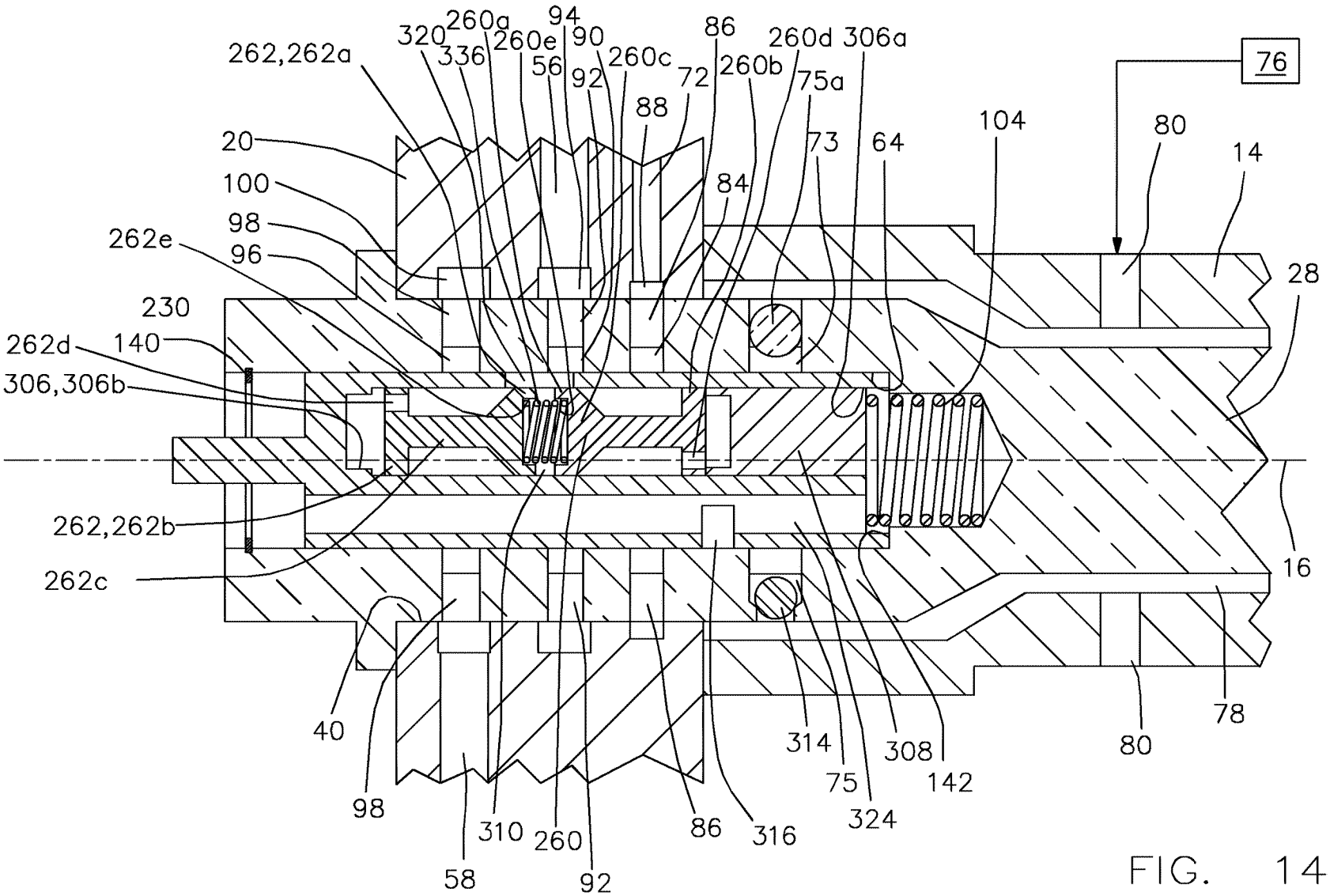
Figure 14C:
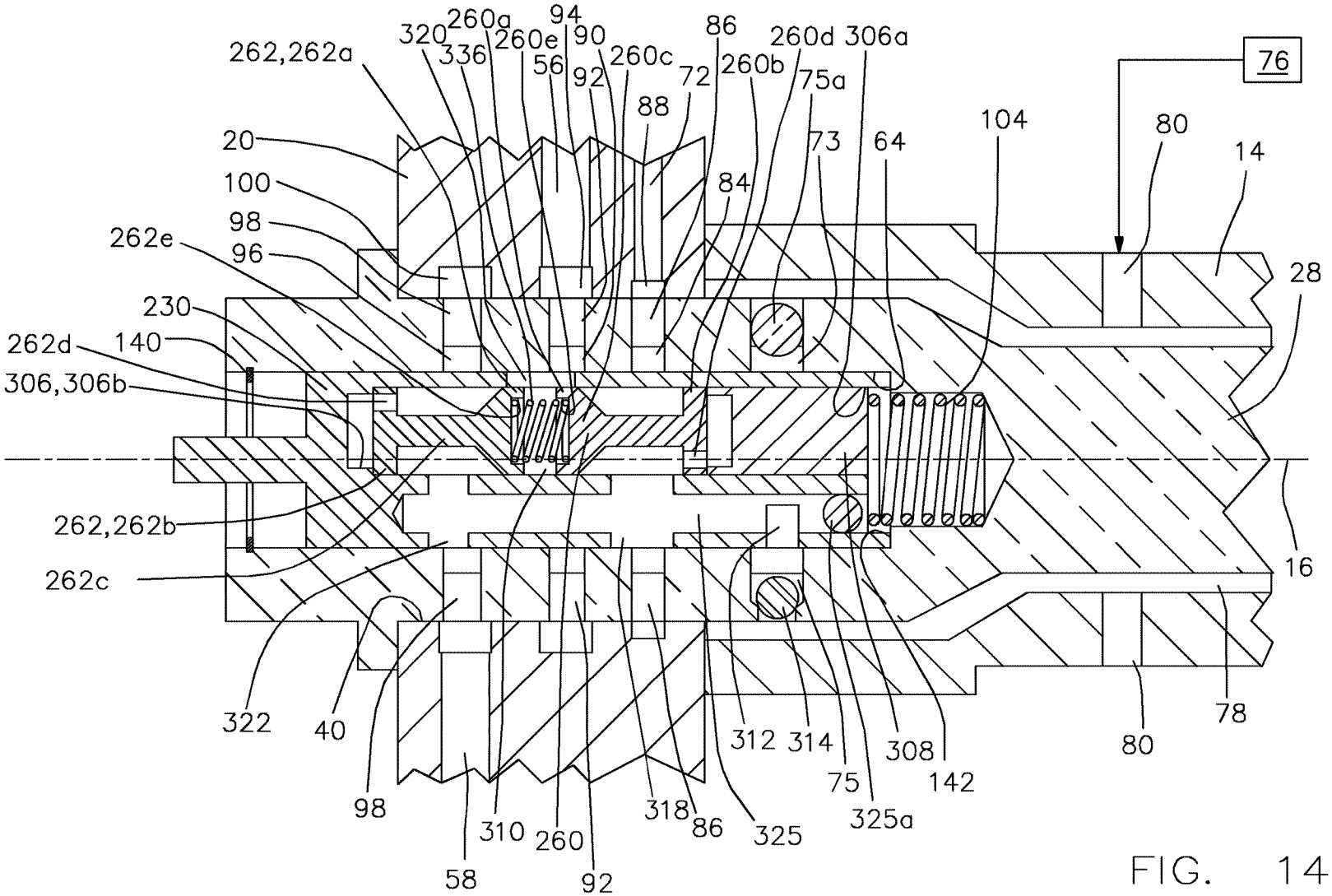
FIGS. 14C and 14D are the views of FIGS. 14A and 14B respectively now with the second check valve closed.
Figure 14D:
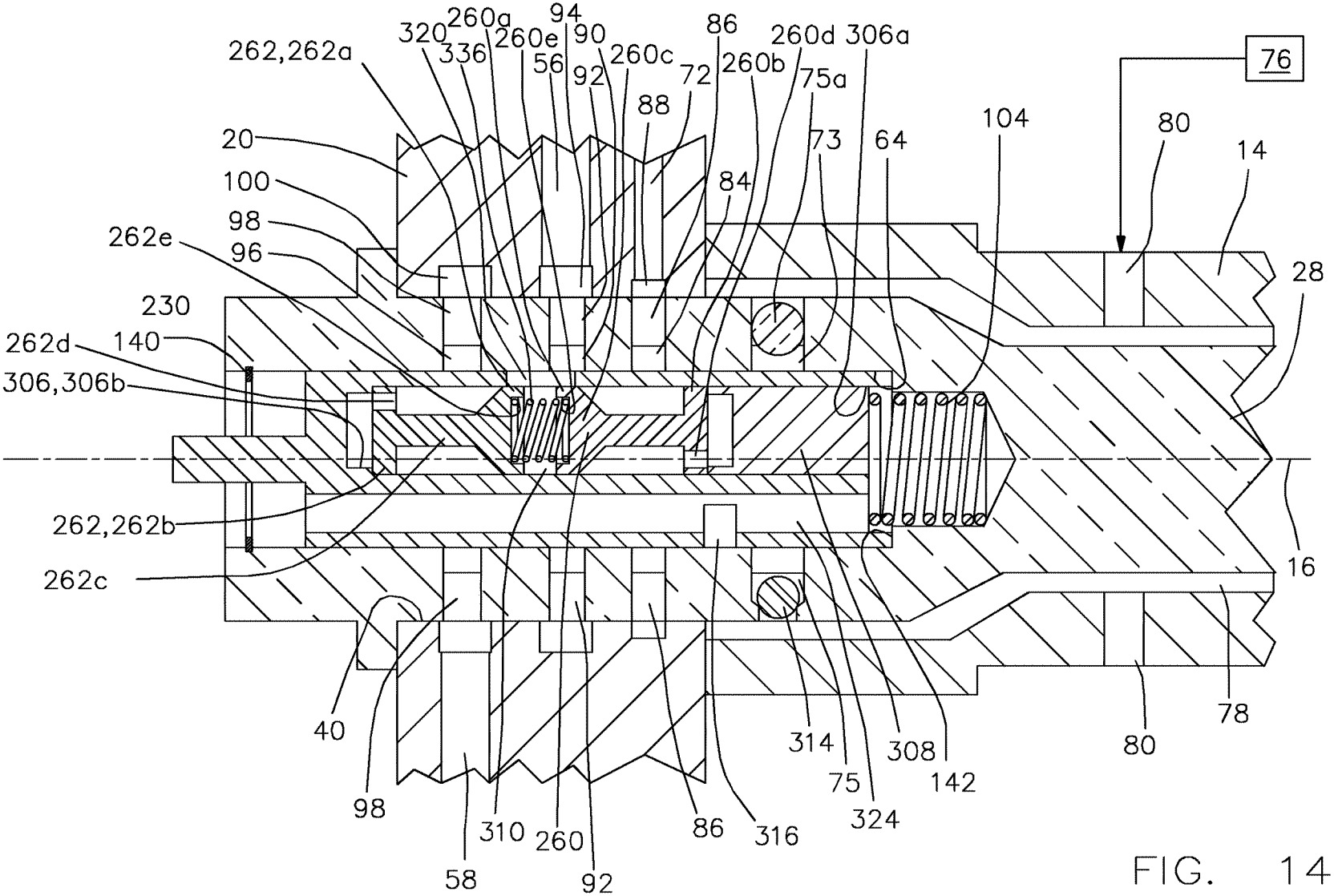
Figure 14E:
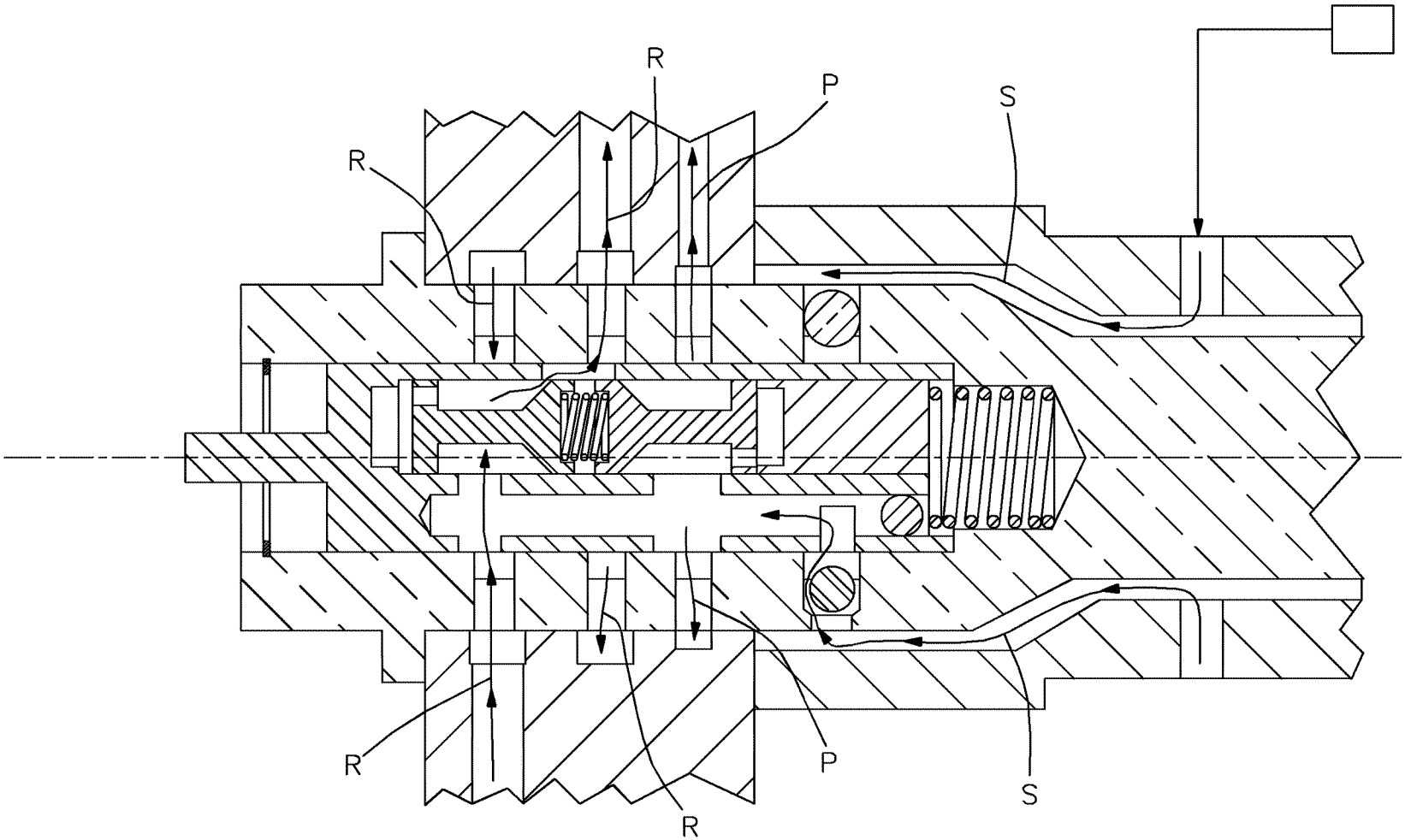
FIG. 14E is the view of FIG. 14A shown with reference numbers removed and arrows added in order to clearly show the path of travel of oil.

In an advance position, when an electric current of a third magnitude is supplied to actuator 102, actuator 102 urges valve spool 230 in a direction toward valve spring 104 as shown in FIGS. 14A-14E, thereby causing valve spring 104 to be compressed slightly more than in the hold position until valve spool 230 abuts second stop member 142. In the advance position, valve spool 230 is positioned to align spool supply passage 312 with bolt annular inner supply groove 73, thereby allowing pressurized oil to be supplied to phasing volume 310 through supply check valve 314 and spool supply bore 325 from oil source 76 when pressure within phasing volume 310 is lower than the pressure of oil source 76. Also in the advance position, valve spool 230 is positioned to block fluid communication between spool lock pin passage 316 and bolt annular lock pin groove 84, thereby preventing oil from being vented from lock pin bore 66. Also in the advance position, valve spool 230 is positioned to align spool advance passages 318 with bolt annular lock pin groove 84, and as a result, lock pin 26 compresses lock pin spring 70 and lock pin 26 is retracted from lock pin seat 68 due to oil supplied to lock pin bore 66 from phasing volume 310/spool supply bore 325. Also in the advance position, valve spool 230 is positioned to prevent fluid communication between phasing volume 310 and bolt annular advance groove 90 through spool advance passages 318. Also in the advance position, valve spool 230 is positioned to align spool recirculation passages 320 with bolt annular advance groove 90, thereby allowing fluid communication between phasing volume 310 and advance chambers 42. Also in the advance position, valve spool 230 is positioned to align spool retard passages 322 with bolt annular retard groove 96, thereby allowing fluid communication between phasing volume 310 and retard chambers 44; however, fluid communication directly between spool recirculation passages 320 and bolt annular retard groove 96 is blocked. In this way, torque reversals of camshaft 14 that tend to pressurize oil within retard chambers 44 cause oil to be vented out of retard chambers 44 and to be supplied to advance chambers 42 via rotor retard passages 58, rotor annular retard groove 100, bolt retard passages 98, bolt annular retard groove 96, spool retard passages 322, phasing volume 310, spool recirculation passages 320, bolt annular advance groove 90, bolt advance passages 92, rotor annular advance groove 94, and rotor advance passages 56. It should be noted that torque reversals of camshaft 14 that tend to pressurize oil within retard chambers 44 cause second recirculation check valve 262 to move toward first recirculation check valve 260, thereby compressing recirculation check valve spring 336 and causing second recirculation check valve sealing portion 262*a* to permit fluid communication between spool recirculation passages 320 and spool retard passages 322 as shown in FIGS. 14A and 14B. However, torque reversals of camshaft 14 that tend to pressurize oil within advance chambers 42 are prevented from venting oil from advance chambers 42 because torque reversals that tend to pressurize oil within advance chambers 42, together with recirculation check valve spring 336, cause second recirculation check valve 262 to move away from first recirculation check valve 260 until second recirculation check valve guiding portion 262*b* abuts the end of valve spool 230 which defines valve spool bore closed end 306*b*, thereby preventing fluid communication between spool recirculation passages 320 and spool retard passages 322 as shown in FIGS. 14C and 14D. Consequently, in the advance position, torque reversals of camshaft 14 cause rotor 20 to rotate relative to stator 18 to cause an advance in timing of camshaft 14 relative to the crankshaft. FIG. 14E is the same as FIG. 14A except the reference numbers have been removed for clarity and arrows representing the path of travel of the oil have been included where arrows S represent oil from oil source 76, arrows R represent oil that is being recirculated for rotating rotor 20 relative to stator 18, and arrows P represent oil that is pressurized to retract lock pin 26 from lock pin seat 68.

Figure 2:
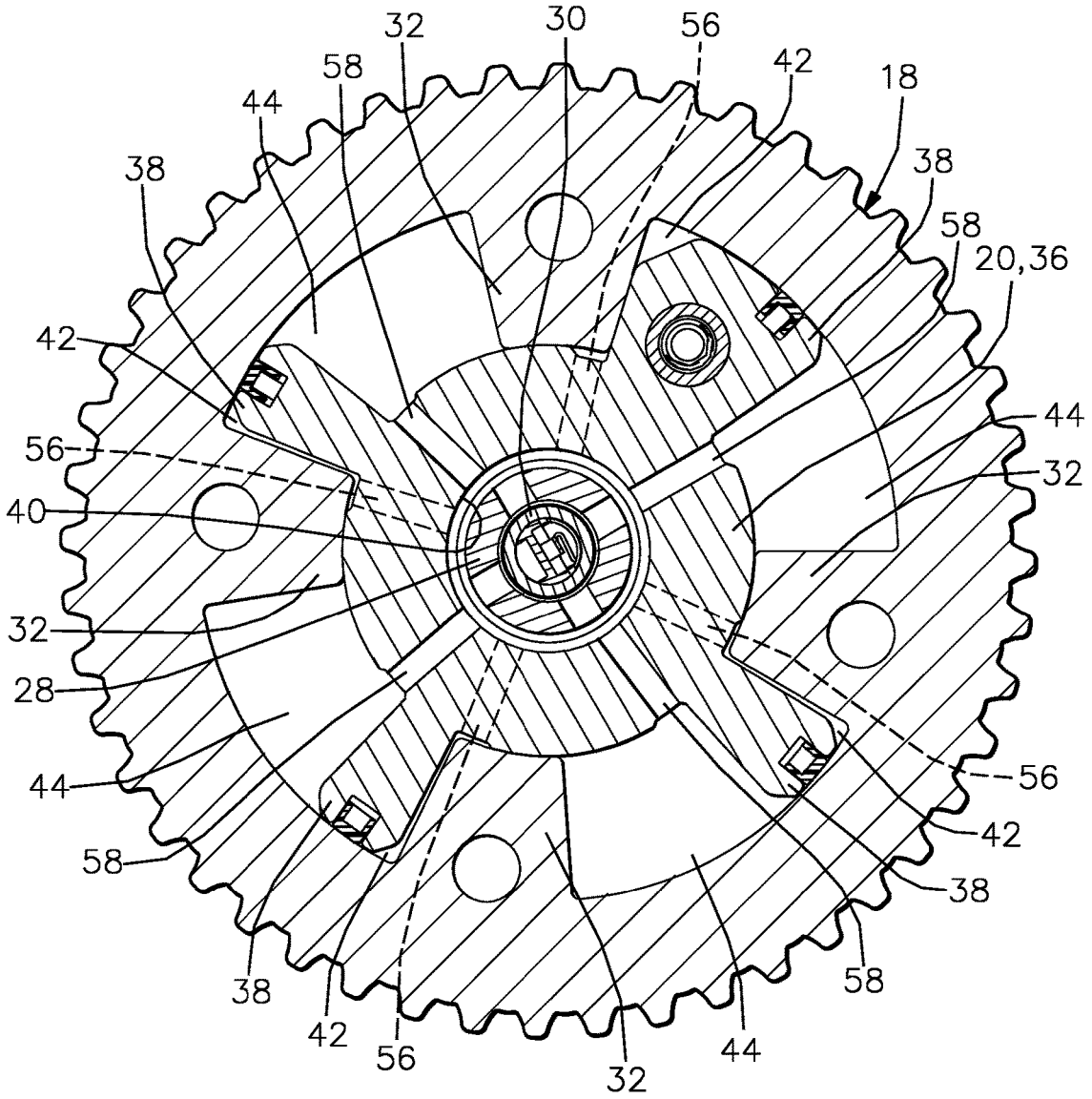
FIG. 2 is a radial cross-sectional view of the camshaft phaser in accordance with the present invention.
Figure 3:
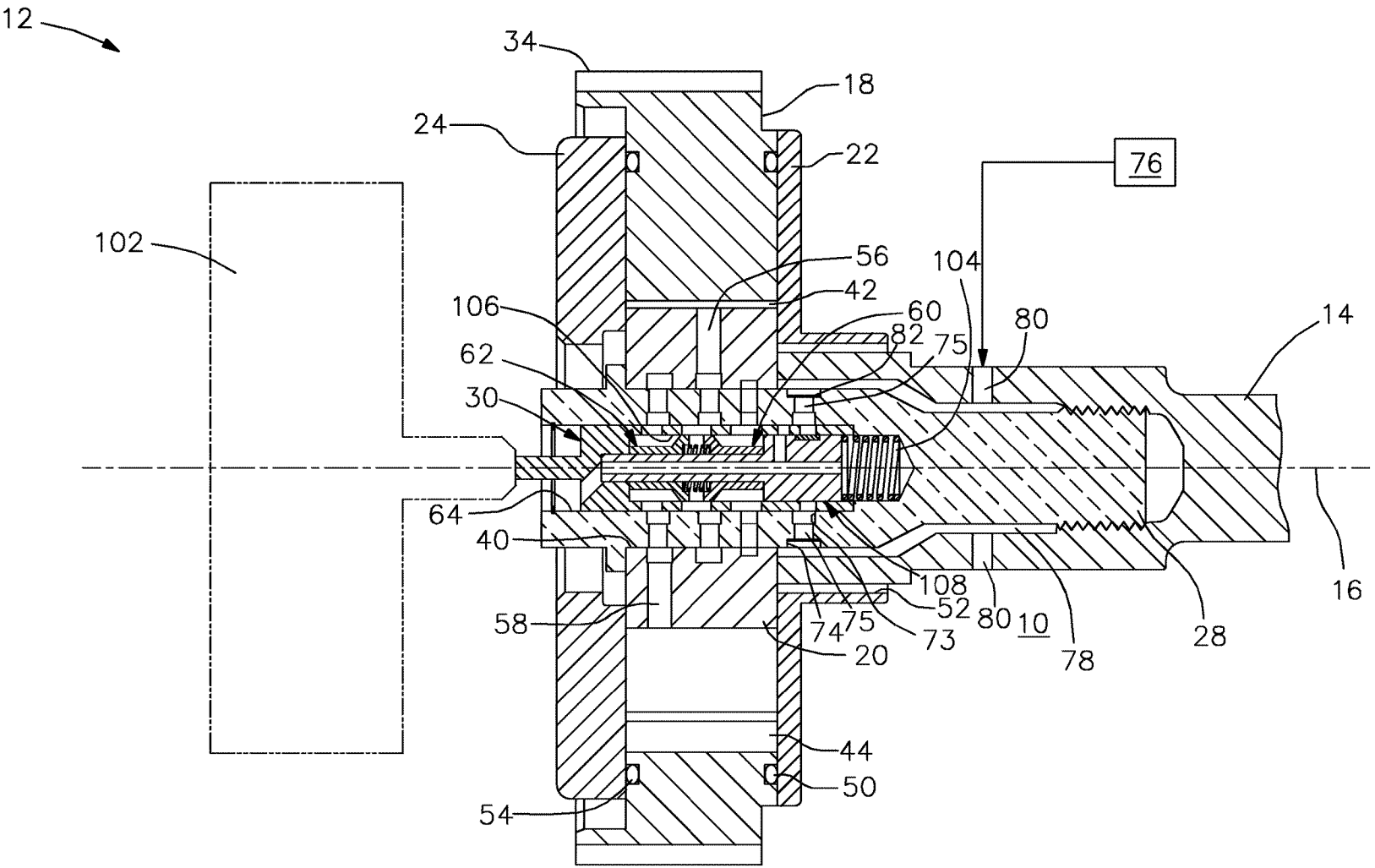
FIG. 3. is an axial cross-sectional view of the camshaft phaser in accordance with the present invention taken through advance and retard passages of a rotor of the camshaft phaser.
Figure 4:
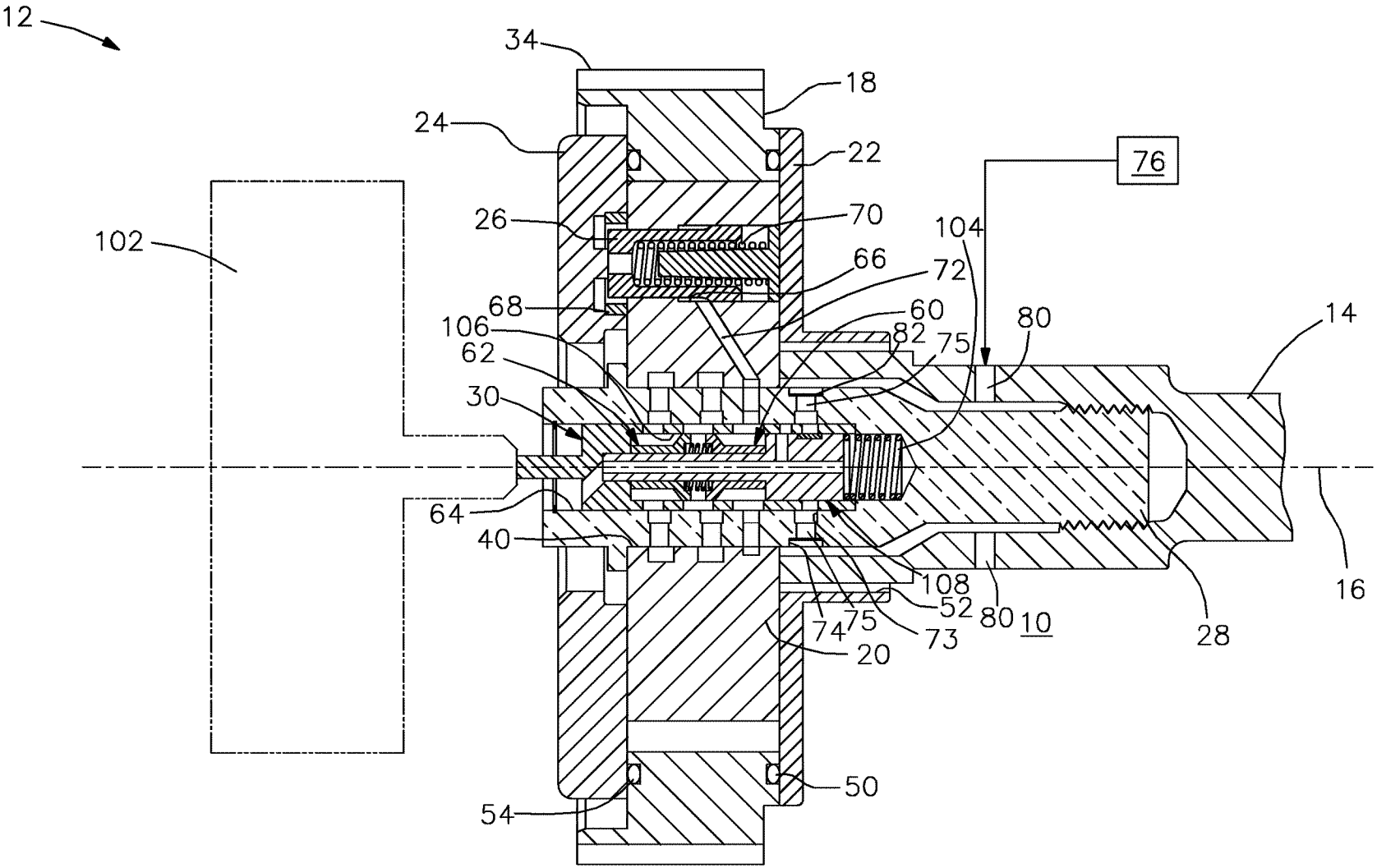
FIG. 4. is an axial cross-sectional view of the camshaft phaser in accordance with the present invention taken through a lock pin of the camshaft phaser.

While camshaft phaser 12 has been described as defaulting to full retard, it should now be understood that camshaft phaser 12 may alternatively default to full advance by simply rearranging oil passages. Similarly, while full retard has been described as full counterclockwise rotation of rotor 20 within stator 18 as shown in FIG. 2, it should also now be understood that full retard may alternatively be full clockwise rotation of rotor 20 within stator 18 depending on whether camshaft phaser 12 is mounted to the front of internal combustion engine 10 (shown in the figures) or to the rear of internal combustion engine 10.

While rotor 20 has been described herein as including grooves formed in rotor central through bore 40 which are aligned with corresponding passages formed in camshaft phaser attachment bolt 28, it should now be understood that the grooves in rotor central through bore 40 could be omitted and the grooves could instead be formed on the outer periphery of camshaft phaser attachment bolt 28. Furthermore, grooves could alternatively be formed both in rotor central through bore 40 and on the outer periphery of camshaft phaser attachment bolt 28.

Valve spool 30, 230, insert 108, first recirculation check valve 60, 260, second recirculation check valve 62, 262, and supply check valve 114 as described herein allow for simplified construction and less flow restriction of camshaft phaser 12 compared to the prior art. Furthermore, supplying oil to lock pin 26 from phasing volume 110, 310 eliminates the need for an additional groove in valve spool 30 and an additional groove between camshaft phaser attachment bolt 28 and rotor central through bore 40 to create a separate supply for lock pin 26.

While this invention has been described in terms of preferred embodiments thereof, it is not intended to be so limited, but rather only to the extent set forth in the claims that follow.

I claim:

1. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member;

a valve spool moveable along an axis between an advance position and a retard position and having a valve spool bore with a phasing volume defined within said valve spool bore, said valve spool having a spool recirculation passage extending from said valve spool bore;

a first recirculation check valve disposed within said valve spool bore such that said first recirculation check valve is moveable axially within said valve spool bore;

a second recirculation check valve disposed within said valve spool bore such that said second recirculation check valve is moveable axially within said valve spool bore; and a biasing member which biases said first recirculation check valve and said second recirculation check valve away from each other;

wherein said first recirculation check valve allows oil to pass from said advance chamber to said retard chamber through said spool recirculation passage when said valve spool is in said retard position and said first recirculation check valve prevents oil from passing from said retard chamber to said advance chamber when said valve spool is in said retard position, thereby retarding the timing of said camshaft relative to crankshaft; and wherein said second recirculation check valve allows oil to pass from said retard chamber to said advance chamber through said spool recirculation passage when said valve spool is in said advance position and said second recirculation check valve prevents oil from passing from said advance chamber to said retard chamber when said valve spool is in said advance position, thereby advancing the timing of said camshaft relative to said crankshaft.

2. A camshaft phaser as in claim 1 wherein:

said camshaft phaser further comprises an insert disposed within said valve spool bore such that said phasing volume is defined in part by said insert, said insert having an insert recirculation check valve guide;

said first recirculation check valve has a first recirculation check valve guide bore which extends through said first recirculation check valve such that said insert recirculation check valve guide extends through said first recirculation check valve guide bore in a close sliding fit which allows said first recirculation check valve to slide axially on said insert recirculation check valve guide while preventing oil from passing between said first recirculation check valve guide bore and said insert recirculation check valve guide; and said second recirculation check valve has a second recirculation check valve guide bore which extends through said second recirculation check valve such that said insert recirculation check valve guide extends through said second recirculation check valve guide bore in a close sliding fit which allows said second recirculation check valve to slide axially on said insert recirculation check valve guide while preventing oil from passing between said second recirculation check valve guide bore and said insert recirculation check valve guide.

3. A camshaft phaser as in claim 2 wherein said insert recirculation check valve guide is centered about said axis.

4. A camshaft phaser as in claim 2 wherein one end of said insert recirculation check valve guide is radially supported by a spool vent passage formed in said valve spool at one end of said valve spool bore.

5. A camshaft phaser as in claim 4 wherein said insert includes an insert vent passage which extends axially through said insert such that said insert vent passage provides fluid communication between said spool vent passage and an end of said insert which is distal from said spool vent passage.

6. A camshaft phaser as in claim 5 further comprising a lock pin which selectively engages a lock pin seat, wherein pressurized oil supplied to said lock pin causes said lock pin to retract from said lock pin seat to permit relative movement between said input member and said output member and wherein venting oil from said lock pin allows said lock pin to engage said lock pin seat in order to prevent relative motion between said input member and said output member at a predetermined aligned position;

wherein said insert includes an insert lock pin vent passage extending from said insert vent passage such that said insert lock pin vent passage selectively communicates with said lock pin in order to vent oil from said lock pin.

7. A camshaft phaser as in claim 2 wherein:

said first recirculation check valve has a first recirculation check valve counter bore which is coaxial with said first recirculation check valve guide bore;

said second recirculation check valve has a second recirculation check valve counter bore which is coaxial with said second recirculation check valve guide bore; and said biasing member is received within said first recirculation check valve counter bore and said second recirculation check valve counter bore.

8. A camshaft phaser as in claim 2 wherein:

said first recirculation check valve includes a first recirculation check valve sealing portion which mates with said valve spool bore in a close sliding fit such that oil is prevented from passing between the interface of said first recirculation check valve sealing portion and said valve spool bore and such that said first recirculation check valve sealing portion allows oil to pass from said advance chamber to said retard chamber through said spool recirculation passage when said valve spool is in said retard position and said first recirculation check valve sealing portion prevents oil from passing from said retard chamber to said advance chamber when said valve spool is in said retard position; and said second recirculation check valve includes a second recirculation check valve sealing portion which mates with said valve spool bore in a close sliding fit such that oil is prevented from passing between the interface of said second recirculation check valve sealing portion and said valve spool bore and such that said second recirculation check valve sealing portion allows oil to pass from said retard chamber to said advance chamber through said spool recirculation passage when said valve spool is in said advance position and said second recirculation check valve sealing portion prevents oil from passing from said advance chamber to said retard chamber when said valve spool is in said advance position.

9. A camshaft phaser as in claim 2 wherein:

said valve spool includes a spool supply passage which receives oil from an oil source;

a supply check valve is located within said valve spool bore such that said supply check valve permits oil to flow to said phasing volume from said oil source and prevents oil from flowing out of said phasing volume through said spool supply passage; and said insert includes an insert supply check valve retention groove which maintains the position of said supply check valve in said valve spool bore.

10. A camshaft phaser as in claim 9 wherein:

said spool supply passage is a first spool supply passage and said valve spool includes a second spool supply passage which receives oil from said oil source;

said supply check valve includes a supply check valve central portion which is received within said insert supply check valve retention groove; and said supply check valve includes a pair of supply check valve wings which each extend laterally from said supply check valve central portion in opposite directions such that one of said supply check valve wings permits oil to flow to said phasing volume from said oil source through said first spool supply passage and prevents oil from flowing out of said phasing volume through said first spool supply passage and such that the other of said supply check valve wings permits oil to flow to said phasing volume from said oil source through said second spool supply passage and prevents oil from flowing out of said phasing volume through said second spool supply passage.

11. A camshaft phaser as in claim 1 wherein:

said camshaft rotates about said axis; and said valve spool bore is centered about said axis.

12. A camshaft phaser as in claim 1 wherein:

said camshaft rotates about said axis; and said valve spool bore is parallel to said axis and laterally offset from said axis.

13. A camshaft phaser as in claim 12 further comprising a spool supply bore extending into said valve spool such that said spool supply bore receives oil from an oil source, said spool supply bore being parallel to said valve spool bore and laterally offset from said valve spool bore, said spool supply bore being in fluid communication with said valve spool bore.

14. A camshaft phaser as in claim 13 further comprising:

a lock pin which selectively engages a lock pin seat, wherein pressurized oil supplied to said lock pin causes said lock pin to retract from said lock pin seat to permit relative movement between said input member and said output member and wherein venting oil from said lock pin allows said lock pin to engage said lock pin seat in order to prevent relative motion between said input member and said output member at a predetermined aligned position; and a spool vent passage which extends axially through said valve spool such that said spool vent passage does not communicate with said valve spool bore, said spool vent passage being parallel to said valve spool bore and laterally offset from said valve spool bore such that said spool vent passage selectively communicates with said lock pin in order to vent oil from said lock pin.

15. A camshaft phaser as in claim 13 wherein:

said first recirculation check valve includes a first recirculation check valve sealing portion which mates with said valve spool bore in a close sliding fit such that oil is prevented from passing between the interface of said first recirculation check valve sealing portion and said valve spool bore and such that said first recirculation check valve sealing portion allows oil to pass from said advance chamber to said retard chamber through said spool recirculation passage when said valve spool is in said retard position and said first recirculation check valve sealing portion prevents oil from passing from said retard chamber to said advance chamber when said valve spool is in said retard position; and said second recirculation check valve includes a second recirculation check valve sealing portion which mates with said valve spool bore in a close sliding fit such that oil is prevented from passing between the interface of said second recirculation check valve sealing portion and said valve spool bore and such that said second recirculation check valve sealing portion allows oil to pass from said retard chamber to said advance chamber through said spool recirculation passage when said valve spool is in said advance position and said second recirculation check valve sealing portion prevents oil from passing from said advance chamber to said retard chamber when said valve spool is in said advance position.

16. A camshaft phaser as in claim 15 wherein:

said first recirculation check valve includes a first recirculation check valve guiding portion which is spaced axially from said first recirculation check valve sealing portion such that said first recirculation check valve guiding portion is joined to said first recirculation check valve sealing portion by a first recirculation check valve connecting portion, said first recirculation check valve guiding portion being sized to mate with said valve spool bore in a close sliding fit which prevents radial movement of said first recirculation check valve guiding portion within said valve spool bore, and said first recirculation check valve connecting portion being sized to provide radial clearance with said valve spool bore such that said phasing volume is defined in part circumferentially between said first recirculation check valve connecting portion and said valve spool bore; and said second recirculation check valve includes a second recirculation check valve guiding portion which is spaced axially from said second recirculation check valve sealing portion such that said second recirculation check valve guiding portion is joined to said second recirculation check valve sealing portion by a second recirculation check valve connecting portion, said second recirculation check valve guiding portion being sized to mate with said valve spool bore in a close sliding fit which prevents radial movement of said second recirculation check valve guiding portion within said valve spool bore, and said second recirculation check valve connecting portion being sized to provide radial clearance with said valve spool bore such that said phasing volume is defined in part circumferentially between said second recirculation check valve connecting portion and said valve spool bore.

17. A camshaft phaser as in claim 16 wherein:

said first recirculation check valve guiding portion includes a first recirculation check valve bore extending axially therethrough; and said second recirculation check valve guiding portion includes a second recirculation check valve bore extending axially therethrough.

18. A camshaft phaser as in claim 15 wherein:

said first recirculation check valve sealing portion has a first recirculation check valve counter bore;

said second recirculation check valve sealing portion has a second recirculation check valve counter bore; and said biasing member is received within said first recirculation check valve counter bore and said second recirculation check valve counter bore.

* * * * *